US006912823B2

(12) United States Patent
MacDonald et al.

(10) Patent No.: US 6,912,823 B2
(45) **Date of Patent: *Jul. 5, 2005**

(54) MULTI-CHANNEL RETAINING WALL BLOCK AND SYSTEM

(75) Inventors: Robert A. MacDonald, Plymouth, MN (US); Robert J. Race, Eagan, MN (US)

(73) Assignee: Keystone Retaining Wall Systems, Inc., Bloomington, MN (US)

( * ) Notice: Subject to any disclaimer, the term of this patent is extended or adjusted under 35 U.S.C. 154(b) by 232 days.

This patent is subject to a terminal disclaimer.

(21) Appl. No.: 10/194,433

(22) Filed: Jul. 11, 2002

(65) Prior Publication Data

US 2003/0029114 A1 Feb. 13, 2003

Related U.S. Application Data

(63) Continuation-in-part of application No. 09/904,038, filed on Jul. 12, 2001, now Pat. No. 6,854,231.

(51) Int. Cl.[7] ..... E04C 2/04; E02D 29/02

(52) U.S. Cl. ..... 52/574; 52/562; 52/605; 52/608; 52/747.12; 405/284; 405/262

(58) Field of Search ..... 52/561–565, 574–575, 52/585.1, 592.1, 600, 603–608, 747.12; 405/284, 286, 262

(56) References Cited

U.S. PATENT DOCUMENTS

| | | | | | |
|---|---|---|---|---|---|
| D30,288 | S | * | 2/1899 | Vrooman | D23/422 |
| 3,418,774 | A | * | 12/1968 | Kocher et al. | 52/437 |
| 4,738,059 | A | | 4/1988 | Dean, Jr. | |
| 4,914,876 | A | | 4/1990 | Forsberg | |
| 4,920,712 | A | | 5/1990 | Dean, Jr. | |
| 5,161,918 | A | | 11/1992 | Hodel | |
| 5,181,362 | A | * | 1/1993 | Benitez | 52/591.1 |
| 5,214,898 | A | | 6/1993 | Beretta | |
| RE34,314 | E | | 7/1993 | Forsberg | |
| 5,267,816 | A | | 12/1993 | Mercer et al. | |
| 5,294,216 | A | | 3/1994 | Sievert | |
| D346,031 | S | * | 4/1994 | Risi et al. | D25/114 |
| 5,417,523 | A | | 5/1995 | Scales | |
| 5,511,902 | A | | 4/1996 | Center | |
| 5,511,910 | A | | 4/1996 | Scales | |
| 5,528,873 | A | * | 6/1996 | Correia et al. | 52/605 |
| 5,535,568 | A | | 7/1996 | Quinn | |
| 5,595,460 | A | | 1/1997 | Miller et al. | |
| 5,598,679 | A | | 2/1997 | Orton et al. | |
| 5,619,835 | A | | 4/1997 | Bailey, II et al. | |
| 5,644,891 | A | | 7/1997 | Kafarowski | |
| 5,673,530 | A | | 10/1997 | Bailey, II | |
| 5,816,749 | A | | 10/1998 | Bailey, II | |

(Continued)

FOREIGN PATENT DOCUMENTS

| | | |
|---|---|---|
| WO | WO 97/44533 | 11/1997 |

OTHER PUBLICATIONS

Co–pending, commonly assigned U.S. Appl. No. 09/904,037, filed Jul. 12, 2001.

*Primary Examiner*—Winnie Yip
(74) *Attorney, Agent, or Firm*—Popovich, Wiles & O'Connell, P.A.

(57) ABSTRACT

A retaining wall block system having multiple sizes and shapes of blocks with differently dimensioned, interchangeable front and back faces. The blocks are used to construct an irregularly textured wall having a weathered, natural appearance. Multiple channels in the lower face of the block are used to engage pins in pin-receiving apertures to form an attachment system. A side connection system is particularly useful for stabilizing free-standing walls. Horizontal reinforcing members are also used in the channels and vertical reinforcing members are used in cores of adjacent blocks for reinforcing a wall. Reinforcing geosynthetic materials can also be firmly held in a wall by means of the pins or by connectors adapted to fit in the block channels.

15 Claims, 21 Drawing Sheets

U.S. PATENT DOCUMENTS 5,823,709 A 10/1998 Maher et al.
5,848,511 A 12/1998 Scales
5,911,539 A 6/1999 Egan et al.
5,984,589 A * 11/1999 Ciccarello ..... 405/284
6,019,550 A 2/2000 Wrigley et al.
6,024,517 A 2/2000 Castonguay et al.
6,035,599 A 3/2000 Sonnentag
6,115,983 A * 9/2000 Poignard ..... 52/606
6,149,352 A * 11/2000 MacDonald ..... 405/284
6,205,735 B1 * 3/2001 Witcher ..... 52/604
6,224,295 B1 5/2001 Price et al.
6,280,121 B1 8/2001 Khamis
6,443,663 B1 9/2002 Scales et al.
6,488,448 B1 * 12/2002 Blomquist et al. ..... 405/284

* cited by examiner

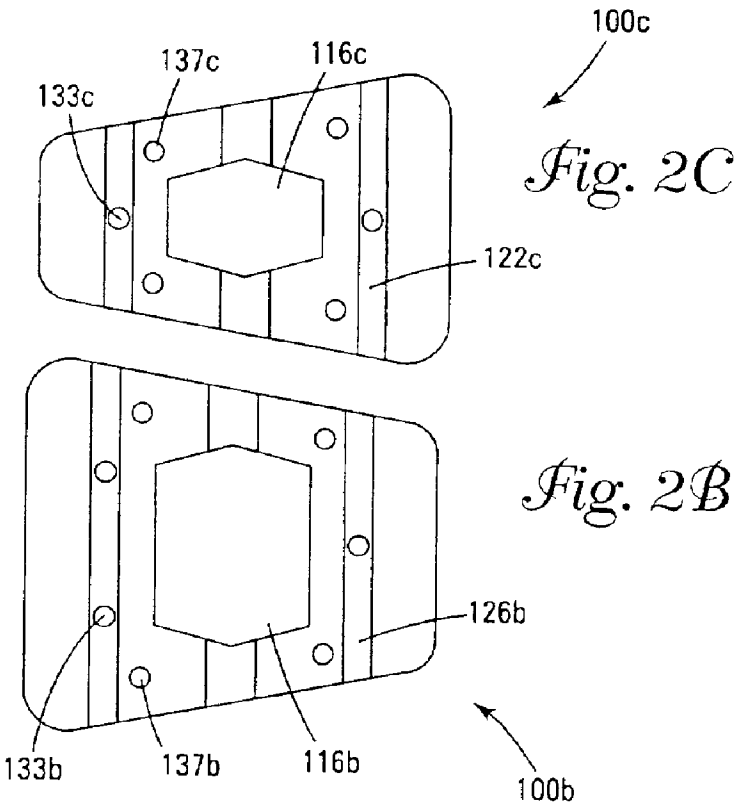
Fig. 2C
Fig. 2B
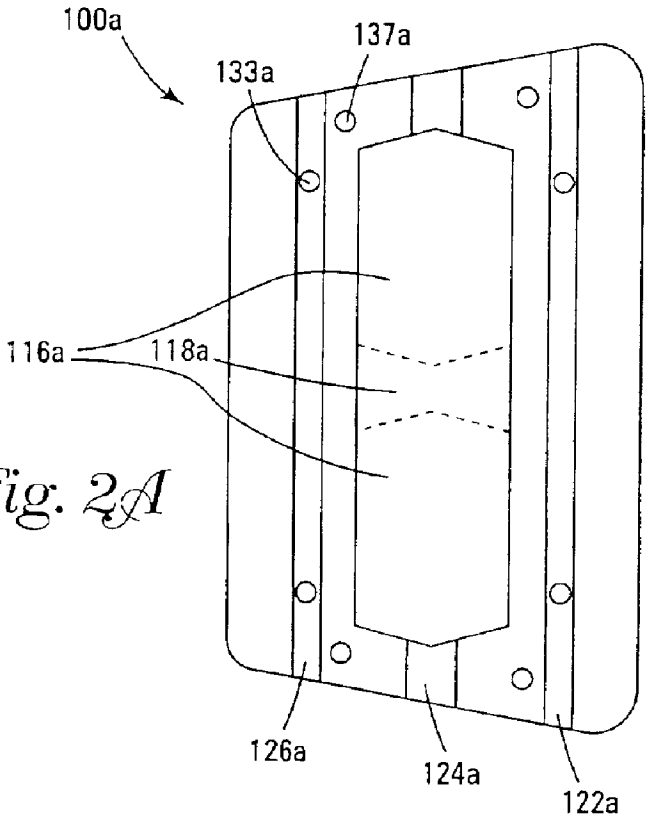
Fig. 2A

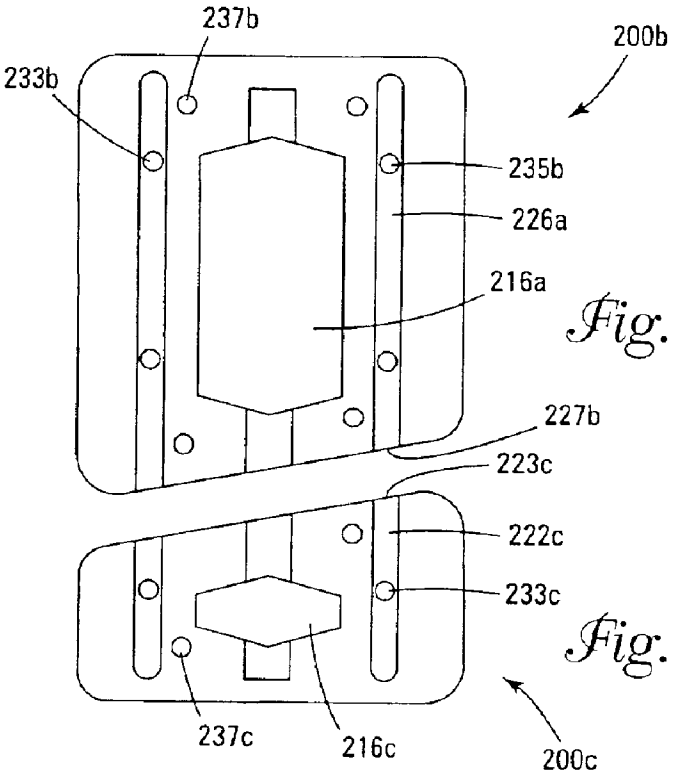
Fig. 4B
Fig. 4C
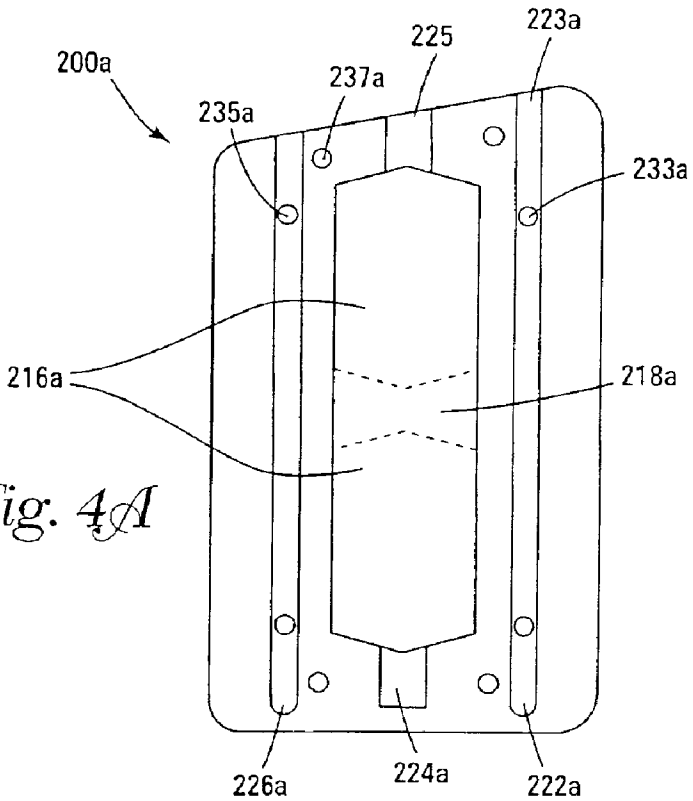
Fig. 4A

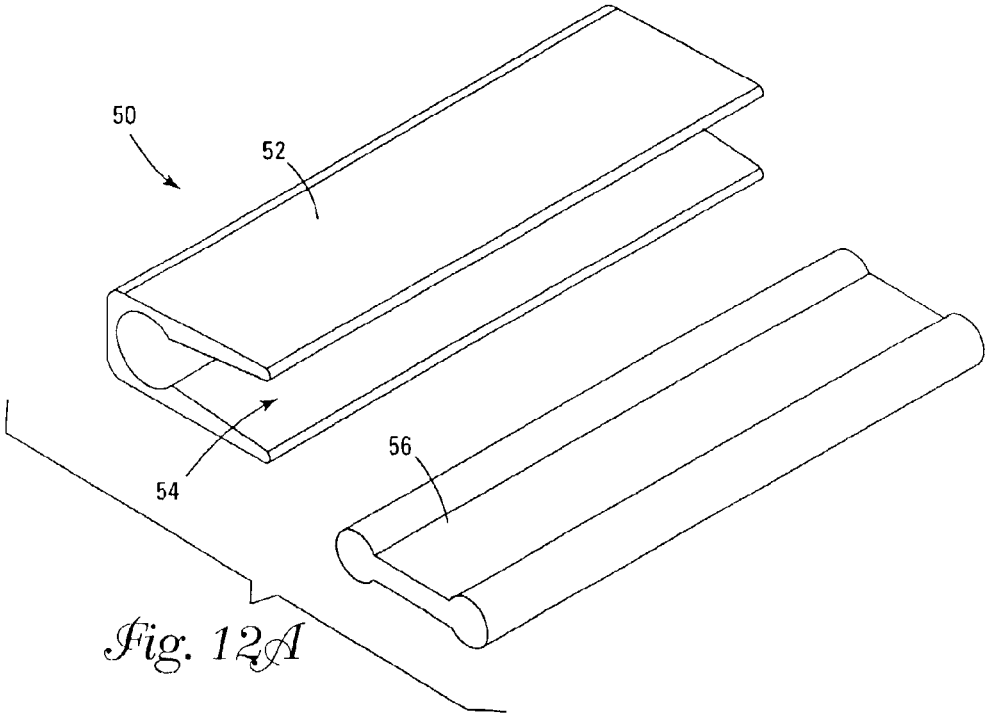
Fig. 12A
Fig. 12B
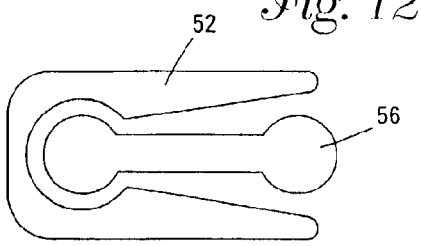

MULTI-CHANNEL RETAINING WALL BLOCK AND SYSTEM

This application is a continuation-in-part of U.S. application Ser. No. 09/904,038, filed Jul. 12, 2001 now U.S. Pat. No 6,854,231.

FIELD OF THE INVENTION

This invention relates generally to retaining wall blocks and retaining walls constructed from such blocks. In particular, this invention relates to retaining wall blocks having channels, pin receiving apertures, and cores and a wall system made from such blocks that can be reinforced horizontally as well as vertically.

BACKGROUND OF THE INVENTION

Retaining walls are used in various landscaping projects and are available in a wide variety of styles. Numerous methods and materials exist for the construction of retaining walls. Such methods include the use of natural stone, poured concrete, precast panels, masonry, and landscape timbers or railroad ties.

In recent years, segmental concrete retaining wall units, which are dry stacked (i.e., built without the use of mortar), have become widely accepted in the construction of retaining walls. An example of such a unit is described in U.S. Pat. No. Re 34,314 (Forsberg). Such retaining wall units have gained popularity because they are mass produced and, consequently, relatively inexpensive. They are structurally sound, easy and relatively inexpensive to install, and couple the durability of concrete with the attractiveness of various architectural finishes. The retaining wall system described in U.S. Pat. No. Re 34,314 (Forsberg) has been particularly successful because of its use of a block design that includes, among other design elements, a unique pinning system that interlocks and aligns the retaining wall units, thereby providing structural strength and allowing efficient installation. This system is advantageous in the construction of larger walls, when combined with the use of geogrids hooked over the pins, as described in U.S. Pat. No. 4,914,876 (Forsberg).

Another important feature of retaining wall blocks is the appearance of the block. The look of weathered natural stone is very appealing for retaining walls. There are several methods in the art to produce concrete retaining wall blocks having an appearance that to varying degrees mimics the look of natural stone. One well known method is to split the block during the manufacturing process so that the front face of the block has a fractured concrete surface that looks like a natural split rock. This is done by forming a slab in a mold and providing one or more grooves in the slab to function as one or more splitting planes. The slab is then split apart to form two or more blocks. Another method is wherein blocks are individually formed in a mold and the surfaces are textured by removal of the mold. Additional machine texturing processes can then be applied.

Creating a random, or ashlar, pattern in the face of a retaining wall is highly desirable. This gives the appearance of a mortared or dry-stacked natural stone wall, which is a traditional and well accepted look. Some current wall blocks are intended to create an ashlar pattern. However, the creation of a truly random appearance requires the production of multiple block shapes for use in a single retaining wall. This is inefficient from a production standpoint because this requires multiple molds and more kinds of blocks to inventory. If only one face of the block is intended to be the front face, then the block system will suffer a trade-off between having enough face sizes to create a random, natural appearance and the cost and inefficiency of using multiple molds and creating multiple inventory items.

Because of the natural variation in size of the stones used in stone retaining walls, the wall surface has variations in width from stone to stone. A system capable of duplicating this effect is described in U.S. Pat. No. 6,149,352 (MacDonald), hereby incorporated herein by reference in its entirety. This system uses blocks of different widths and a connection system comprising a channel on each block and multiple pin receiving cavities to align the blocks. Thus this system can be used to produce a wall having random variations in face width and high structural integrity of the wall structure.

However, problems still remain in the field of retaining walls. Easy-to-use methods and systems that permit strengthening the wall, as well as tying in reinforcing geogrids into the earth behind a retaining wall, are continually sought.

It would be desirable to have a system of blocks for constructing a retaining wall that combines the ability to improve the reinforcement of the wall with the ease of installation of modern segmental retaining walls, while still providing for an attractive appearance of a natural stone wall. The block system should allow the construction of freestanding walls, straight walls, curved walls and walls with 90 degree corners.

SUMMARY OF THE INVENTION

This invention is a block system comprising multiple sizes and shapes of blocks with differently dimensioned, interchangeable front and back faces. The blocks can be used to construct an eye-pleasing, irregularly textured wall having a weathered, natural appearance. The texture of the wall is due to the variation in the size of the blocks, the weathered, natural appearance on the surfaces of the individual blocks, and the placement of the blocks in the wall. The shape of the blocks permits construction of stable walls that are curved or straight as well as providing for walls having 90 degree corners.

The blocks are provided with cores, pin-receiving apertures, and multiple channels. Pins are used in the pin-receiving apertures to connect blocks in adjacent courses together. A further attachment system is formed by the use of reinforcing members within the channels on the blocks and/or through the cores of adjacent blocks.

In one aspect, this invention is a wall comprising at least a first lower course and a second upper course, each course comprising a plurality of blocks; each block having an upper surface spaced apart from an opposed lower surface, thereby defining a block thickness; opposed first and second faces, the first face having an area greater than the second face; opposed and non-parallel side surfaces, the first and second faces together with the upper, lower and side surfaces forming a block body; one of the side surfaces having at least one elongate slot extending between the upper and lower surfaces, the other of the side surfaces having a projection shaped to mate with a slot on a side surface of an adjacent block in the wall; and the blocks being positioned in the courses such that the front surface of the wall is formed from the first faces of a portion of the multiple wall blocks and the second faces of others of the multiple wall blocks.

The lower surface of the block may have first and second or third channels substantially parallel to the first and second faces. Each block may have the same thickness. The first and second channels each may open onto one of the side surfaces or onto each of the side surfaces. Each block may have a core and/or at least one pin receiving cavity extending through the block thickness. The pin receiving cavity may open onto the upper surface of the block or open into one of the at least two channels. The width of the blocks is defined by the first face of the blocks and the blocks may comprise blocks of three different block widths. The wall may further comprise horizontal reinforcing members adapted to fit within one of the first and second channels of the blocks. Each block may further comprise at least one core extending the thickness of the block. The wall may further comprise vertically aligned blocks in the first lower course and the second upper course and vertical reinforcing members adapted to fit through the cores of vertically aligned blocks. The upper surface of each block may have pin receiving apertures substantially perpendicular to the upper and lower surfaces of the blocks. The first and second faces and at least one side surface may be textured in a manner resulting in the appearance of natural stone.

In another aspect, this invention is a wall block for use in forming a wall from multiple wall blocks, the wall having a front surface and a rear surface, the block comprising an upper surface spaced apart from an opposed lower surface, thereby defining a block thickness; opposed first and second faces, the first face having an area greater than the second face; opposed and non-parallel side surfaces, the first and second faces together with the upper, lower and side surfaces forming a block body; one of the side surfaces having at least one elongate slot extending between the upper and lower surfaces shaped to mate with a projection on a side surface of an adjacent block in the wall; and wherein the block body is configured for construction of a wall having a front surface of the wall formed of the first faces of a portion of the multiple wall blocks and the second faces of others of the multiple wall blocks. The lower surface of the block further may comprise first and second channels substantially parallel to the first and second faces.

In another aspect, this invention is a method of constructing a wall, the wall having a front surface and a rear surface, the method comprising providing a plurality of blocks as described above, and placing the blocks in a first lower course and a second upper course such that the front surface of the wall is formed from the first faces of a portion of the multiple wall blocks and the second faces of others of the multiple wall blocks.

In another aspect, this invention is a wall system for constructing a reinforced retaining wall having at least a first lower course of blocks and a second upper course of blocks, the wall system comprising a plurality of blocks as described above, the upper surface of the blocks having at least one pin receiving aperture, a pin sized to be contained within the pin receiving aperture of a block to extend above the upper surface of the block a predetermined distance, a geogrid; and a geogrid connector, the blocks being configured such that they are capable of being positioned when constructing the wall so that the first channel of the lower surface of a block in the upper course receives a pin extending from the upper surface of a block of the lower course and the second channel of the lower surface of the block in the upper course receives the geogrid connector such that the geogrid is secured within the second channel by the geogrid connector.

In yet another aspect, this invention is a wall having a front surface and a rear surface, the wall comprising at least a first lower course and a second upper course, the upper and lower courses comprising a plurality of first and second blocks; each block having an upper surface spaced apart from an opposed lower surface, thereby defining a block thickness; each block having opposed first and second faces, thereby defining a block length, the first face having an area greater than the area of the second face; the first blocks each having first and second converging side surfaces, one of the side surfaces having at least one elongate slot extending between the upper and lower surfaces, the other of the side surfaces having a projection shaped to mate with a slot on a side surface of an adjacent block in the wall; the second blocks each having opposed and non-parallel side surfaces, a first side surface being substantially perpendicular to the first face and a second side surface being substantially non-perpendicular to the first face, one of the side surfaces having at least one elongate slot extending between the upper and lower surfaces, the other of the side surfaces having a projection shaped to mate with a slot on a side surface of an adjacent block in the wall; the blocks being positioned in the courses such that the front surface of the wall is comprised of the first faces of a plurality of the first and second blocks and the second faces of a plurality of the first and second blocks.

The lower surfaces of the first and second blocks each may have at least two channels that open onto the first and second side surfaces, the at least two channels parallel to the first and second faces. The least two channels may be three channels. The wall may comprise a straight section and a corner section, wherein the straight section comprises a plurality of the first blocks, and the corner section comprises a plurality of the second blocks, oriented in such a manner to form a 90 degree angle. The width of the blocks may be defined by the first face of the blocks and the second blocks may comprise blocks of three different block widths. The wall may also include horizontal reinforcing members that fit in one of the channels. The blocks may also have at least one core extending the thickness of the first and the second blocks, and vertical reinforcing members adapted to fit through the cores of vertically aligned blocks. The upper surfaces of the blocks may have pin receiving apertures substantially perpendicular to the upper and lower surfaces of the blocks.

The wall may also include pins, each pin having a head portion and a body portion, the head portion being configured to be received within one of the at least two channels of the lower surface of the block in the second upper course of the wall and the body portion being configured to be received in the pin receiving aperture of the block in the first lower course of the wall. The blocks may be textured in a manner resulting in the appearance of natural stone.

In another aspect, this invention is a method of constructing a wall, the wall having a front surface and a rear surface, comprising providing a plurality of blocks, each block having an upper surface spaced apart from an opposed lower surface, thereby defining a block thickness; each block having opposed first and second faces, thereby defining a block length, the first face having an area greater than the area of the second face; the first blocks each having first and second converging side surfaces, the width of the blocks defined by the first face; the first and second blocks each having opposed and non-parallel side surfaces, thereby defining a block width, one of the side surfaces being substantially perpendicular to the first face, one of the side surfaces having at least one elongate slot extending between the upper and lower surfaces, the other of the side surfaces having a projection shaped to mate with a slot on a side surface of an adjacent block in the wall, and placing the blocks in at least a first lower course and a second upper course such that the front surface of the wall is comprised of the first faces of the plurality of the first and second blocks and the second faces of a plurality of the first and second blocks.

The blocks may have at least two channels that open onto the first and second side surfaces, each channel parallel to the first and second faces. They also may have at least one pin receiving aperture extending through the block thickness substantially perpendicular to the upper and lower surfaces. The method then further includes placing a pin having a head portion and a body portion into the pin receiving aperture such that the body portion is in the pin receiving aperture of the block in the first lower course and the head portion is configured to be received in one of the at least two channels of the block in the second upper course. The blocks may also have an attachment system that allows the blocks in the first lower course to be attached to the blocks in the second upper course. There may be a geogrid between the first lower course and the second upper course.

In another aspect, this invention is a retaining wall having at least a first lower course of blocks and a second upper course of blocks, the wall comprising a plurality of blocks as described above, and a pin having a body portion and a head portion, the body portion sized to be contained within the pin receiving aperture of a block and the head portion extending above the upper surface of the block a predetermined distance, such that the head portion is engaged in one of the first and second channels of the lower surface of the block in the second upper course, thus forming an attachment between the courses of blocks.

In yet another aspect, this invention is a method for constructing a reinforced retaining wall system having at least a first lower course of blocks and a second upper course of blocks, comprising providing a plurality of blocks, each block having an upper surface spaced apart from an opposed lower surface, thereby defining a block thickness; opposed first and second faces, the first face having an area greater than the second face; opposed and non-parallel side surfaces, the first and second faces together with the upper, lower and side surfaces forming a block body; the lower surface having first and second channels substantially parallel to the first and second faces; the upper surface of the blocks having at least one pin receiving aperture, one of the side surfaces having at least one elongate slot extending between the upper and lower surfaces, the other of the side surfaces having a projection shaped to mate with a slot on a side surface of an adjacent block in the wall, placing a pin within the pin receiving aperture of a block, the pin extending above the upper surface of the block a predetermined distance, providing a geogrid and a geogrid connector; and positioning the blocks when constructing the wall so that a projection on the side surface of one of the blocks mates with the slot on the side surface of an adjacent block and so that the first channel of the lower surface of a block in the upper course receives a pin extending from the upper surface of a block of the lower course and the second channel of the lower surface of the block in the upper course receives the geogrid connector such that the geogrid is secured within the second channel by the geogrid connector.

In another aspect, this invention is a wall block for use in forming a wall from a plurality of wall blocks, the wall having at least a first lower course of blocks and a second upper course of blocks, blocks in the upper course being connected to blocks in the lower course by pins extending from a top surface of blocks in the lower course and received by a pin receiving cavity formed in the bottom surface of blocks in the upper course, the wall block comprising an upper surface spaced apart from an opposed lower surface, thereby defining a block thickness, opposed first and second faces, the first face having an area greater than the second face, opposed and non-parallel side surfaces, the first and second faces together with the upper, lower and side surfaces forming a block body, one of the side surfaces having at least one elongate slot extending between the upper and lower surfaces, the other of the side surfaces having a projection shaped to mate with a slot on a side surface of an adjacent block in the wall, the block body being configured such that when a wall is constructed from the blocks, the projection on the side surface of one of the blocks mates with a slot on the side surface of an adjacent block, and the front surface of the wall is formed of the first faces of a portion of the multiple wall blocks and the second faces of others of the multiple wall blocks.

The lower surface of the block may also have first and second channels substantially parallel to the first and second faces, the first channel functioning as the pin receiving cavity when the first face forms a portion of a front surface of the wall and the second channel functioning as the pin receiving cavity when the second face forms a portion of a front surface of the wall.

In another aspect, this invention is a wall having at least a first lower course of blocks and a second upper course of blocks, the wall comprising a plurality of wall blocks, the blocks in the upper course being connected to blocks in the lower course by pins extending from a top surface of blocks in the lower course and received by a pin receiving cavity formed in the bottom surface of blocks in the upper course, the front surface of the wall being formed of the first faces of a portion of the multiple wall blocks and the second faces of others of the multiple wall blocks and the wall being formed such that the projection on the side surface of one of the blocks mates with a slot on the side surface of an adjacent block.

In another aspect, this invention is a method of constructing a wall having at least a first lower course of blocks and a second upper course of blocks, comprising providing a wall block comprising an upper surface spaced apart from an opposed lower surface, thereby defining a block thickness; a pin receiving aperture substantially perpendicular to the upper and lower surfaces; opposed first and second faces, the first face having an area greater than the second face; opposed and non-parallel side surfaces, the first and second faces together with the upper, lower and side surfaces forming a block body; one of the side surfaces having at least one elongate slot extending between the upper and lower surfaces, the other of the side surfaces having a projection shaped to mate with a slot on a side surface of an adjacent block in the wall, placing a pin in the pin receiving aperture so that it extends from the top surface of the block in the lower course, and connecting blocks in the upper course to blocks in the lower course by the pin received by a pin receiving cavity on the bottom surface of blocks in the upper course, such that the front surface of the wall is formed of the first faces of a portion of the multiple wall blocks and the second faces of others of the multiple wall blocks and such that the projection on the side surface of one of the blocks mates with a slot on the side surface of an adjacent block.

BRIEF DESCRIPTION OF THE DRAWINGS

FIGS. 2A, 2B, and 2C illustrate bottom views of the first embodiment of the retaining wall blocks.

FIGS. 4A, 4B, and 4C illustrate bottom views of the second embodiment of the retaining wall blocks.

FIG. 12A illustrates a perspective view of a geogrid channel connector; FIG. 12B illustrates a cross section view of the connector.

DETAILED DESCRIPTION OF THE PREFERRED EMBODIMENTS

In this application, "upper" and "lower" refer to the placement of the block in a retaining wall. The lower, or bottom, surface is placed such that it faces the ground. In a retaining wall, one row of blocks is laid down, forming a course. An upper course is formed on top of this lower course by positioning the lower surface of one block on the upper surface of another block.

Figure 1A:
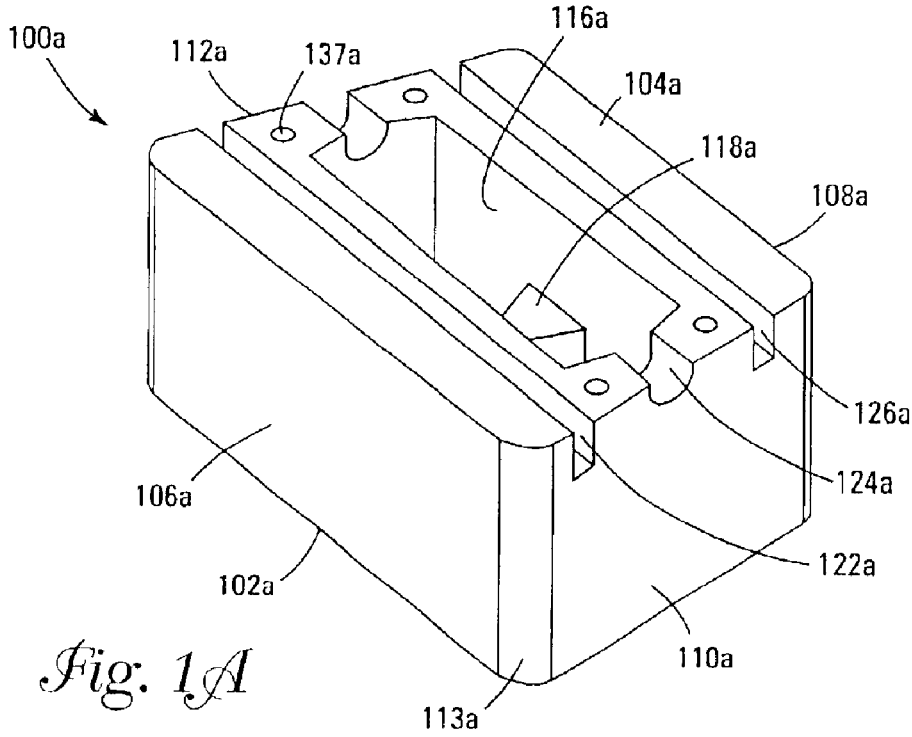
FIGS. 1A and 1B illustrate perspective views of a first embodiment of the retaining wall blocks of this invention, with the lower surfaces facing up.
Figure 1B:
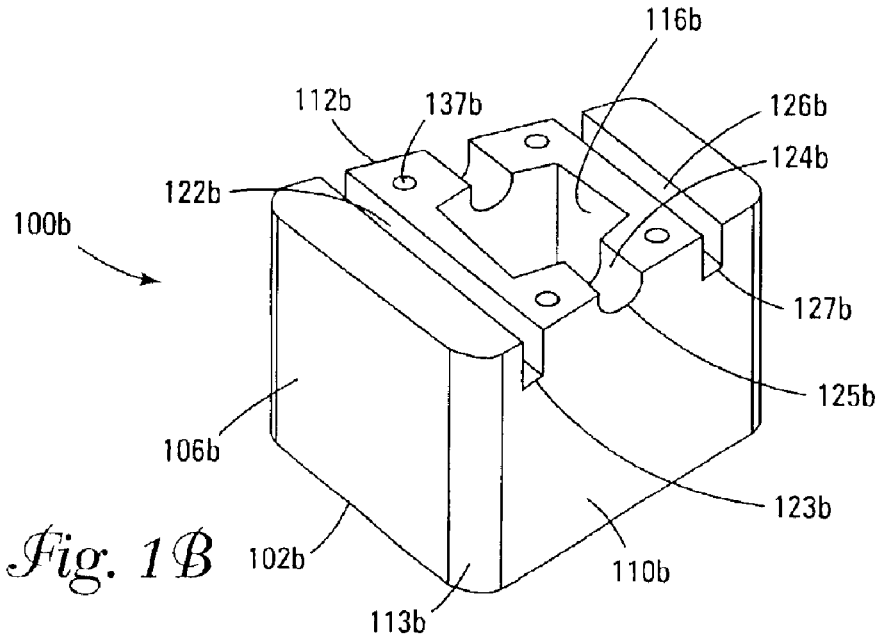

This invention comprises blocks of differing shapes and sizes that are used together in the construction of a wall. The blocks are configured to be compatible with each other in the construction of a retaining wall, a parapet wall, or a free-standing wall. These blocks are provided in two different styles or embodiments, each embodiment of the block having different shapes and sizes. These embodiments may also be provided with a side connection system. A first embodiment (e.g., shown in FIGS. 1A, 1B, 2A to 2C, 5, and 6A) having blocks of three sizes is used in the construction of the wall except for corner or end portions. Two sizes of the blocks are shown in perspective views in FIGS. 1A and 1B. The bottom views of three sizes of blocks are shown in FIGS. 2A to 2C. FIGS. 1A and 2A show the same block. FIGS. 1B and 2B show the same block. The smallest block is shown in bottom view in FIG. 2C.

Figure 3A:
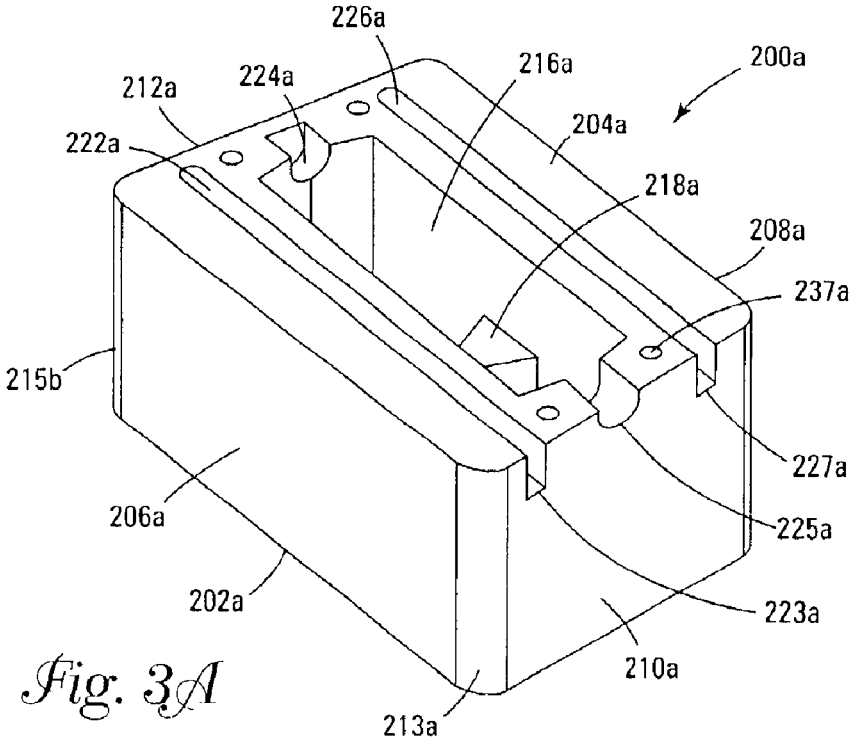
FIGS. 3A and 3B illustrate perspective views of a second embodiment of the retaining wall blocks of this invention, with the lower surfaces facing up.

The second embodiment is shown in FIGS. 3A, 3B, and 4A to 4C. Again, there are blocks of three sizes and these blocks are used most often in constructing the ends or corners of a wall. FIGS. 3A and 4A show the same block and 3B and 4B show the same block. The smallest block is shown only in bottom view in FIG. 4C.

Blocks 100*a* and 200*a* are similarly dimensioned, as are blocks 100*b* and 200*b*, and 100*c* and 200*c*. In this way, the blocks can be used interchangeably and where necessary in a wall. As is well understood in the art, the blocks can be made of any desired dimension. Blocks of three sizes for each embodiment are illustrated, though it is to be understood that many different sizes could be made and used to construct a wall.

Preferably, each block of either embodiment has at least two faces that are textured in a manner resulting in the appearance of natural stone. Three of the faces may be textured, and typically it is desirable that a face that will be placed next to another block in a wall be smooth and untextured. The faces have varying sizes based on variations in width. The orientation of the faces may be reversed so that either the front or the back of the block may serve as an exposed face, to give the wall a pleasing random variation of the block sizes that creates the look of a natural stone wall.

The blocks are provided with pin receiving apertures or holes and multiple channels that together provide for a way to positively connect courses of blocks to each other in a retaining wall. The pin attachment system allows the individual blocks to be aligned with varying degrees of forward or rearward projection, to give the wall builder another means of introducing randomness to the appearance of the wall face. In addition, reinforcing members can be used vertically in the wall and can be used horizontally within the block channels, thus adding additional strength to the wall.

Blocks may also be provided with a side connection system wherein a side of the block is provided with a channel or slot that is configured to engage a corresponding projection on an adjacent block. There may be one or more channels or slots (and corresponding projections) on the block. Typically, and preferably, the side connection system is used on a smooth, untextured side of the block.

The blocks can be used to construct retaining walls, parapet walls, and free-standing walls, columns, and wall pilasters. Such walls may be straight, curved (serpentine) or may have sharp corners (i.e., 90 degree angles). Preferably, there is a natural-appearing finish on all exposed sides of the wall. Reinforcing geogrid tie-backs or geosynthetic fabrics (referred to generally as geogrids and geotextiles) may be used with pins that fit in the pin receiving cavities or with a connector that fits in a channel of a block. The wall system is designed to be easy to install, structurally sound, and to meet or exceed all ASTM, IBC, and AASHTO requirements for retaining wall structures.

The side connection system is a particular advantage in the construction of free-standing walls. This is because the side connection further stabilizes the wall and because the slots and projections prevent light from showing through the wall and together provide for a close fit of the blocks in the wall.

Turning now to the Figures, various block embodiments are described. Many elements in various block embodiments are identical in shape, size, relative placement, and function, and therefore the numbers for these elements do not change. Elements that vary from one block embodiment to another are denoted by suffices "a", "b", "c", "d", and so forth, and may be referred to in a general way by a number without its suffix. In many of the figures, the block is shown with its bottom, or lower, surface facing upward. It should be noted that the block preferably is manufactured with the lower surface facing up, however, when it is used to construct a wall, the lower surface (having the channels) faces down.

FIGS. 1 and 2 illustrate three sizes of a first embodiment of the block of this invention. Perspective views of blocks 100*a* and 100*b* are shown in FIGS. 1A and 1B. Bottom views of blocks 100*a*, 100*b*, and 100*c* are shown in FIGS. 2A to 2C, respectively. The block comprises lower surface 104 opposed and substantially parallel to upper surface 102, and opposing and substantially parallel first and second (also referred to as front and back) faces 106 and 108, respectively. For the purposes of this description, front face 106 is shown facing the viewer in FIG. 1A, however, it is to be understood that front and back are interchangeable when the blocks are used in a wall. The block also comprises opposing and converging side surfaces 110 and 112 (i.e., imaginary lines coincident with side surfaces 110 and 112 will eventually converge at some distance away from the back of block 100*a*). The side surfaces are separated by the width of the block. The side surfaces join the front and back faces to form rounded corners 113. Block 100*a* is shown with lower surface 104 facing up and upper surface 102 facing down. The upper and lower surfaces are separated by the thickness of the block. Block 100*a* is provided with core 116*a* that extends through the thickness of the block. Bridge or divider 118*a* provides support at the center of the core, and can be removed if desired. The lower surface of each block is provided with at least two channels extending the width of the block. In a preferred embodiment, there are three channels, shown as elements 122*a*, 124*a*, and 126*a* on block 100*a*, that extend the width of the block and in a direction substantially parallel to the front and back surfaces of the block. Channels 122*a* and 126*a* each have a depth and a profile sufficient to permit the use of pins having a shoulder or lip to be used in the pin-receiving apertures. Channel 124*a* is typically is more rounded than channels 122*a* and 126*a*, being configured to receive a reinforcing member, as described further below. Channels 122*a*, 124*a*, and 126*a* open onto both side surfaces 110*a* and 112*a*, and these openings are denoted by numbers 123*a*, 125*a*, and 127*a*.

Block 100*b* in FIG. 1B has the same elements as block 100*a*, but core 116*b* has no bridge or divider such as that in block 100*a*. It should be noted that, in a preferred embodiment, side surfaces 100*b* and 110*c* are the same dimension as side surface 110*a* in block 100*a*. Front face 106*b* is not as wide as 106*a*, and front face 106*c* is not as wide as 106*b*, as can be seen by comparing FIG. 2A to FIG. 2B. Block 100*c* also has fewer pin receiving cavities than blocks 100*a* or 100*b*. For each block, 100*a*, 100*b*, and 100*c*, preferably both the front and back faces are textured to have the appearance of natural stone.

Multiple pin receiving apertures or pin holes are provided in the block, and these preferably extend through the thickness of the block on either side of the core. The apertures are in a direction perpendicular to the upper and lower surfaces. For example, pin receiving apertures or holes 133*a* extend through the block and open in channels 122 and 126, respectively, and pin holes 137*a* are shown opening onto lower surface 104*a* of the block 100*a*, as shown in FIG. 2A. Pins are used in the apertures in the channels when it is desired to align blocks directly over one another and thus construct a vertical wall. Pins are used in the other apertures (i.e., such as 137*a*) so that blocks can be offset, and the wall can be provided with set back. This results in a non-vertical wall, as described further below.

Figure 2D:
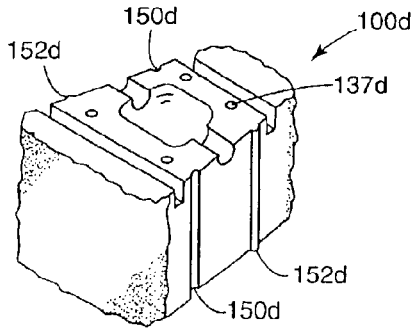
FIGS. 2D, 2E and 2F illustrate perspective views
Figure 2G:
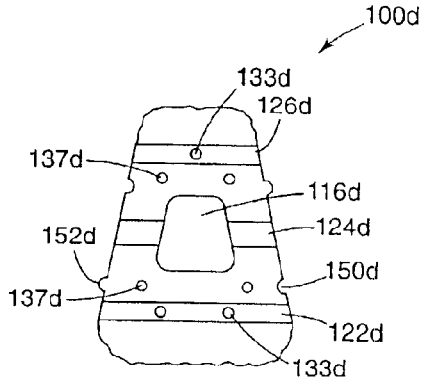
FIGS. 2G, 2H, and 2I show bottom views, respectively, of another embodiment of the retaining wall blocks of this invention.
Figure 2E:
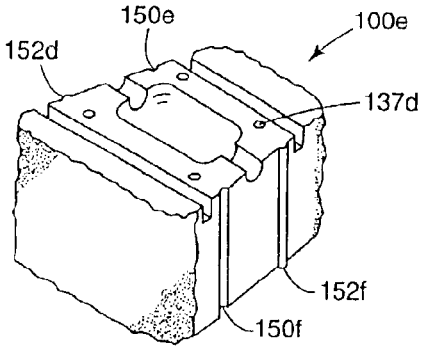
Figure 2H:
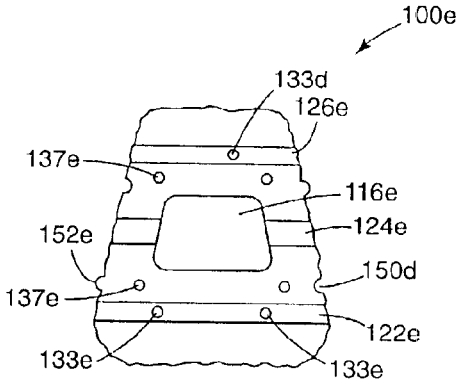
Figure 2F:
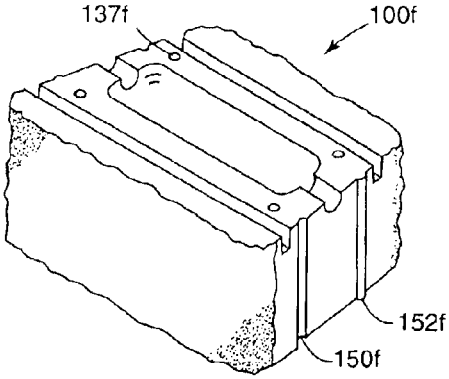
Figure 2I:
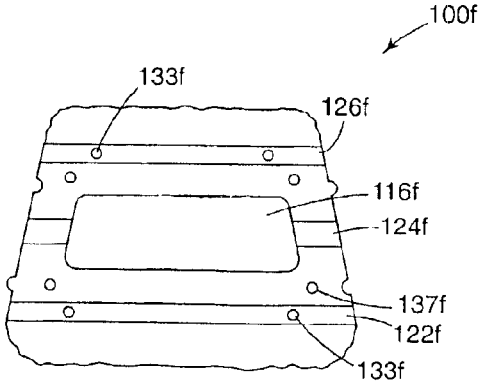

FIGS. 2D, 2E, and 2F show perspective views of three sizes of a block provided with a side connection system. These blocks are substantially similar to the blocks shown in FIGS. 1A and 1B and 2A to 2C except for the side connection system. For simplicity of illustration, the numbers for all the elements are not shown. The lower surface of the block is facing upward for purposes of illustration. Block 100*d* in FIG. 2D and 2G is provided with channels 122*d*, 124*d*, and 126*d*, core 116*d*, and pin holes 133*d* and 137*d*. The exposed surfaces of this block (i.e., when in a wall) are textured and are parallel to the channels on the lower surface of the block. The side surfaces are smooth except for slot 150*d* and projection 152*d*. A corresponding projection 152*d* and slot 150*d* are provided on the opposing side surface. Similarly, larger block 100*e* is shown in FIGS. 2E and 2H and the largest block 100*f* is shown in FIGS. 2F and 2I. Block 100*e* has core 116*e*, channels 122*e*, 124*e*, and 126*e* and pin holes 133*e* and 137*e*. Block 100*f* has core 116*f*. Block 100*f* has channels 122*f*, 124*f*, and 126*f* and pin holes 133*f* and 137*f*. It can be seen that two of these blocks can be placed side by side so that the slots engage with projections on an adjacent block. Typically these blocks would be used in a retaining wall along with other blocks, such as those described in FIGS. 4D to 4I.

Three sizes of another embodiment of the block of this invention are illustrated in FIGS. 3 and 4. The elements of the second embodiment of the block are substantially similar to the elements of the first embodiment.

Figure 3B:
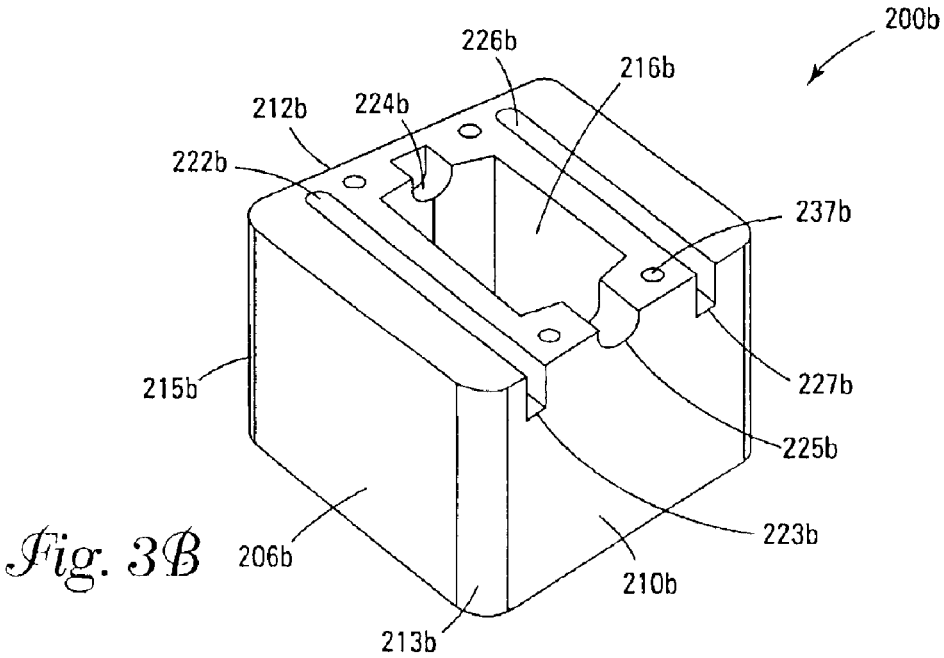

FIGS. 3A and 3B show a perspective view of second block 200*a* and 200*b*, respectively, and corresponding bottom views are shown in FIGS. 4A and 4B. A substantially similar, but smaller, block 200*c* is illustrated in FIG. 4C. The elements of block 200*a* will now be described. Upper surface (facing down in the figure) 202*a* is opposed to and substantially parallel to lower surface 204*a*. Surface 202*a* is separated from surface 204*a* by the thickness of the block. First and second opposed faces 206*a* and 208*a* (also referred to as front and back faces, respectively) are substantially parallel. First face 206*a* has a greater surface area than second face 208*a*. First face 206*a* and second face 208*a* are joined by and orthogonal to first side surface 212*a*. That is, the angle formed by an imaginary line coincident with first face 206*a* and an imaginary line coincident with first side surface 212*a* is 90 degrees, and forms rounded corners 215*a*. First face 206*a* and second face 208*a* also are joined to second side surface 210*a*, thus forming rounded corners 213*a*. Side surfaces 210*a* and 212*a* are opposed and are non-parallel. Similarly, the angle formed between second face 208*a* and first side surface 212*a* is 90 degrees. The angles formed between either of the first and second faces and side surface 210*a* are non-orthogonal.

Block 200*a* is provided with through-passage or core 216*a*. Within core 216*a* is bridge or divider 218*a*. Blocks 200*b* and 200*c* are provided with cores 216*b* and 216*c*, respectively.

The lower surface of each block is provided with at least two channels extending the width of the block. In a preferred embodiment, blocks 200*a*, 200*b*, and 200*c* each have three channels. Lower surface 204*a* is provided with channels

222*a*, 224*a*, and 226*a* that are substantially parallel to the first and second (front and back) surfaces 206*a* and 208*a* and extend the width of the block. Channels 222*a* and 226*a* each have a depth and a profile sufficient to permit the use of pins having a shoulder or lip to be used in the pin-receiving apertures. Channel 224*a* typically is more rounded than channels 222*a* and 226*a*, being configured to receive a reinforcing member, as described further below. Channels 222*a*, 224*a*, and 226*a* extend to one side surface only and open onto the side surface 210*a* forming openings 223*a*, 225*a*, and 227*a*, respectively.

Channels 222*a*, 224*a*, and 226*a* extend to one side surface only because blocks 200*a* to 200*c* are primarily used for the ends or the corners of retaining walls, where the appearance of the block sides are important. That is, side surfaces 212*a*, 212*b*, and/or 212*c* would face the observer at a corner or end of a wall. It is undesirable to have the channels opening onto an exposed side surface. As one of skill in the art knows, however, the blocks could be used anywhere desired in a wall during its construction, simply by altering the block to open a channel to both sides of the block.

The blocks are provided with multiple pin receiving apertures that are in a direction perpendicular to the upper and lower surfaces and preferably extend through the thickness of the block. The figures illustrate blocks having eight or fewer apertures. The channels on either side of the core(s) are provided with pin receiving apertures and there are apertures disposed about either side of the core. Pin receiving apertures 233*a* and 235*a* extend through the block into channels 222*a* and 226*a*, as shown in FIG. 4, and apertures 237*a* are shown opening onto lower surface 204*a* of block 200*a* in FIG. 3A. The apertures are configured similarly to the apertures of blocks 100*a* to 100*c*.

As can be seen in FIGS. 3B and 4, block 200*b* is smaller than block 200*a*. Block 200*c* is smaller still, and has fewer pin receiving cavities than blocks 200*a* or 200*b*. This is because such cavities are sufficient to hold the smaller block in place in a wall.

FIGS. 4D to 4I illustrate another embodiment of this block, with a side connection system similar to that shown in FIGS. 2D to 2I. These blocks are substantially similar to the blocks shown in FIGS. 3A and 3B and 4A to 4C except for the side connection system. For simplicity of illustration, the numbers for all the elements are not shown. It should be noted that the blocks shown in FIGS. 4D to 4I are intended to be used in a column or at the end or a corner of a wall, and thus each block is provided with three textured sides. The channels in the lower surface of each block do not extend to the side surface that will be exposed. This exposed side surface has no projections or slots. The opposing side surface is smooth and nontextured and provided with a side connection system of one or more slots and projections. This serves to strengthen the connection of the blocks in a wall and is a particular advantage for the smallest block (i.e., 200*d*) where a pin connection system might not be used.

Figure 4D:
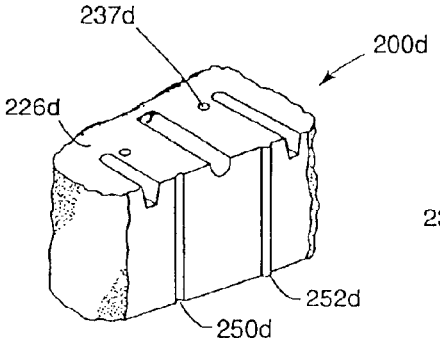
FIGS. 4D, 4E and 4F illustrate perspective views
Figure 4G:
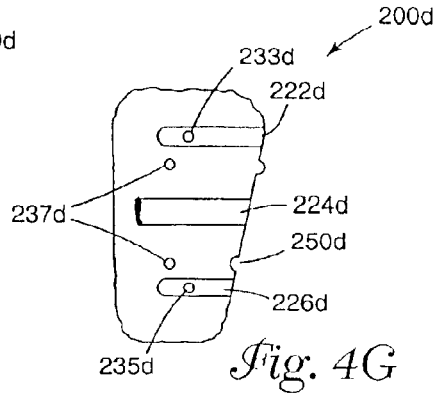
FIGS. 4G, 4H, and 4I show bottom views, respectively, of another embodiment of the retaining wall blocks of this invention.

Smallest block 200*d* also has no core, unlike the blocks shown in FIGS. 2C and 2D. FIGS. 4D and 4G show that the block is provided with channels 222*d* and 226*d*, two pinholes 237*d*, and two pinholes 233*d* in the channels. The block also has, on an untextured surface, slot 250*d* and projection 252*d*.

Figure 4E:
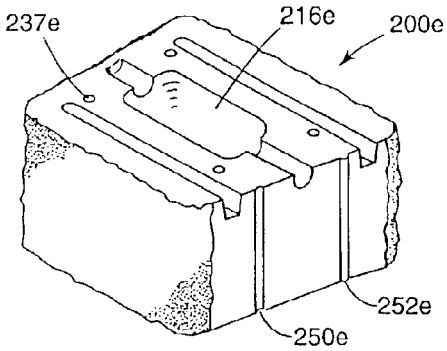
Figure 4H:
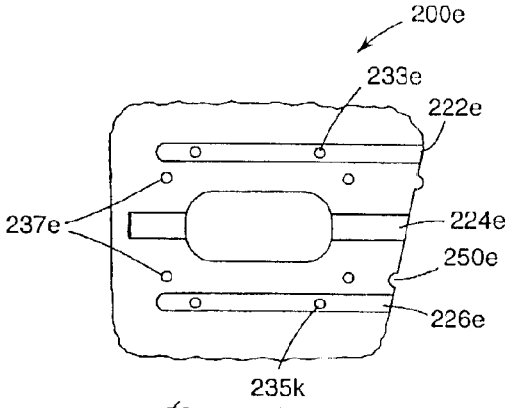
Figure 4I:
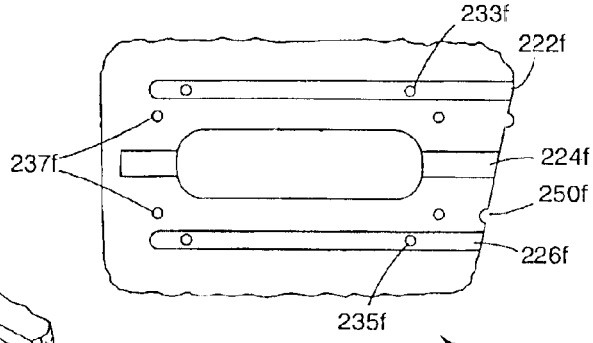
Figure 4F:
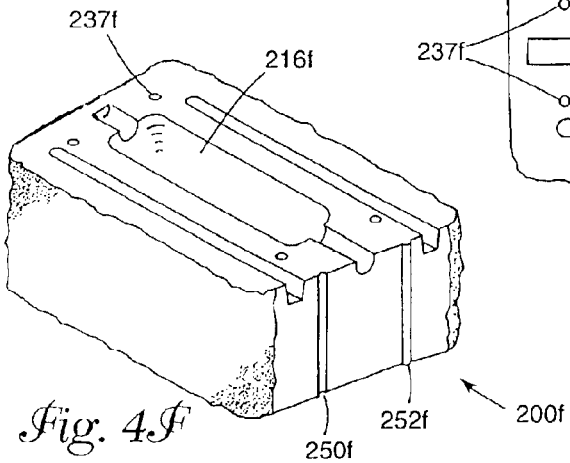
Figure 4J:
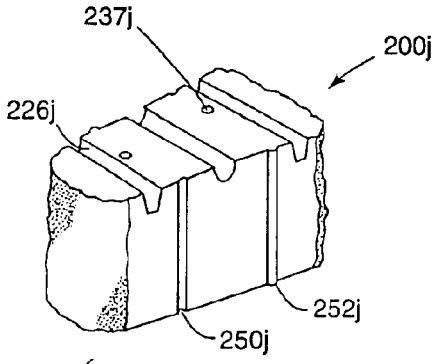
FIGS. 4J, 4K, and 4L illustrate perspective views
Figure 4M:
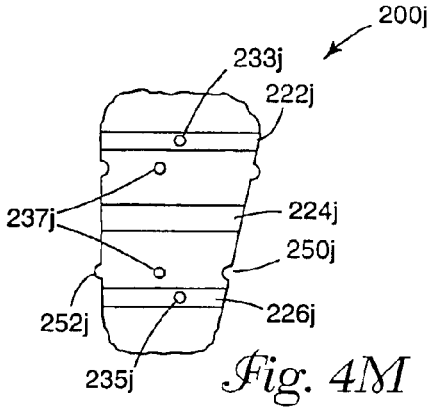
FIGS. 4M, 4N and 4O show bottom views, respectively, of another embodiment of the retaining wall blocks of this invention.
Figure 4K:
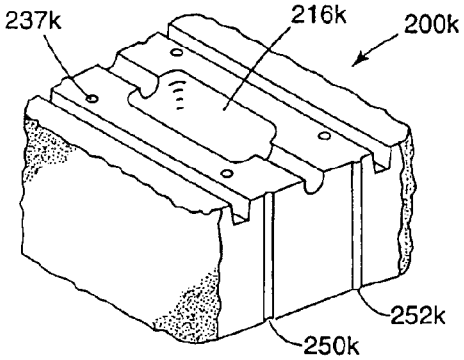
Figure 4N:
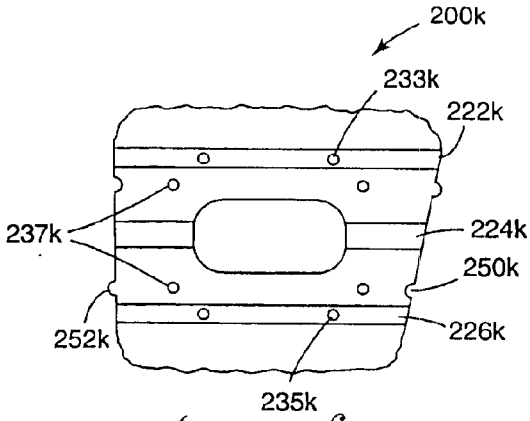
Figure 4L:
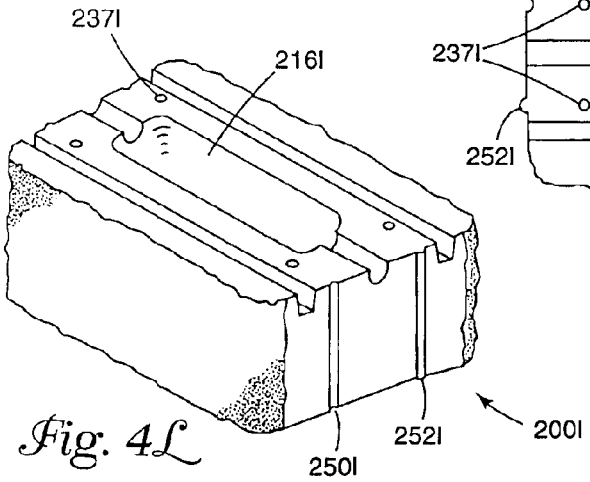
Figure 4O:
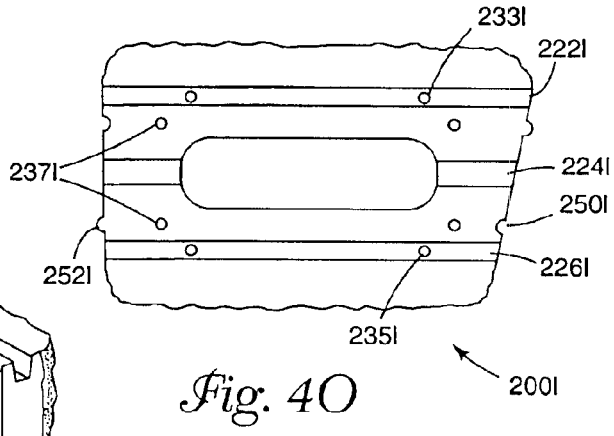

FIGS. 4E and 4H illustrate a larger block, having channels 222*e*, 224*e*, and 226*e*, pinholes 223*e*, 237*e* and 235*e*, and core 216*e*. On one untextured surface is slot 250*e* and projection 252*e*. Largest block 200*f* is shown in FIGS. 4F and 4I, and has having channels 222*f*, 224*f*, and 226*f*, pinholes 223*f*, 237*f* and 235*f*. On one untextured surface is slot 250*f* and projection 252*f*.

FIGS. 4J to 4O illustrate a modification of the block shown in FIGS. 4D to 4I in which the channels extend the width of a block and the opposing side surfaces are both smooth and lacking texture. Both side surfaces are provided with a side connection system and thus are intended for use within a wall. Small block 200*j* has no core, and large block 200*l* has a large core with optional bridge or divider 118*j*. Small block 200*j* has three channels, 222*j*, 224*j* and 226*j*, pin holes 233*j* and 237*j*, and slot 250*j* and projection 252*j* on opposing sides of the block. Block 200*k* in FIGS. 4K and 4N similarly have channels 222*k*, 224*k*, and 226*k*, core 216*k*, pinholes 233*k*, 235*k*, and 237*k*, and slot 250*k* and projection 252*k* on opposing sides of the block. Block 200*l* in FIGS. 4K and 4N similarly have channels 222*l*, 224*l*, and 226*l*, core 216*l*, pinholes 233*l*, 235*l*, and 237*l*, and slot 250*l* and projection 252*l* on opposing sides of the block.

The blocks of either embodiment are made of a rugged, weather resistant material, preferably (and typically) zero-slump molded concrete. Other suitable materials include wet cast concrete, plastic, reinforced fibers, wood, metal and stone. Blocks of this invention are typically manufactured of concrete and cast in a masonry block machine. The sides of the blocks may be tapered. That is, for example, the surface area of the bottom of the block may be larger than the surface area of the top of the block. Tapering is typically due to the manufacturing processes, because it may be easier to remove a block with tapered sides from its mold.

Figure 5A:
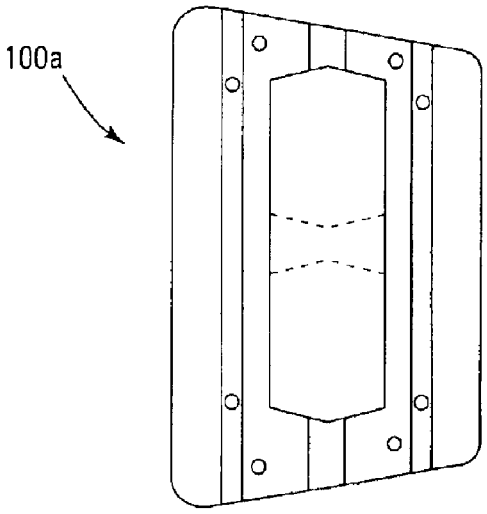
FIG. 5A illustrates a bottom view of the block of FIG. 1A.
Figure 5B:
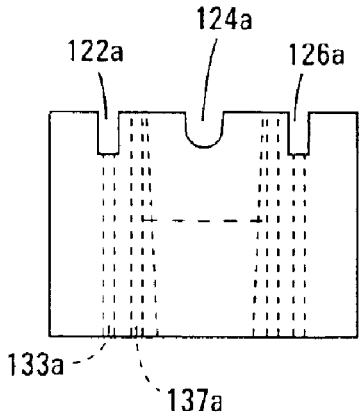
FIG. 5B illustrates a side view of the block FIG. 5A.
Figure 5C:
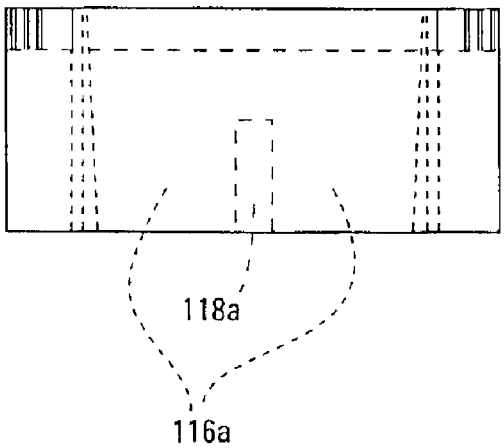
FIG. 5C is a front view of the block shown in FIG. 1A.

Block 100*a* is again illustrated in FIG. 5A, and a side view of block 100*a* is shown in FIG. 5B. The core and four pin receiving apertures are shown in outline in FIG. 5B. FIG. 5C shows the block from the first (i.e., front) face, and the core is shown in outline. For simplicity, only one set of pin receiving apertures is shown in FIG. 5C. It again should be noted that a preferred manufacturing process is to form the blocks with the lower face upward so that the channels can be formed easily. Thus the core may taper from the lower surface to the upper surface because tapering is done for manufacturing ease. Thus the core is wider at the top surface of the block than at the lower surface of the block The block's dimensions are selected not only to produce a pleasing shape for the retaining wall, but also to permit ease of handling and installation. In addition, the dimensions of the channels and the pin receiving cavities are selected as desired. Typically blocks having one thickness and one length are used to construct a retaining wall. However, it may be desirable to use various thicknesses of blocks in a single course of a wall to create a random appearance. For the blocks illustrated in the figures, the length of the blocks (i.e., defined as the distance from the first face to the second face (i.e., front to back)) is about 10 inches (25.4 cm) and the thickness or height of the blocks ranges from about 3 inches (15.2 cm) to about 8 inches (20.3 cm). For example, a desirable thickness for the blocks is about 6 inches (15.2 cm). The first, or front (longer) face of blocks 100*a* and 200*a* is about 16 inches (40.6 cm) wide, and the back is about 14 inches (35.6 cm) wide. The front face of blocks 100*b* and 200*b* is about 10 inches (25.4 cm) wide, and the front face of blocks 100*c* and 200*c* is about 8 inches (*20.3* cm) wide.

Providing a large core (i.e., large relative to the overall block size) is preferred because it results in a reduced weight for the block, thus permitting easier handing during installation of a retaining wall. However, the cores may have any desired dimension. For example, core 116*a* of block 100*a* is about 10.0 inches long and 3 inches wide (25 cm by 7.6 cm).

The smallest core, such as that shown for block 100*c*, is about 4 inches long and 3 inches wide (10.2 cm by 7.6 cm).

Figure 6A:
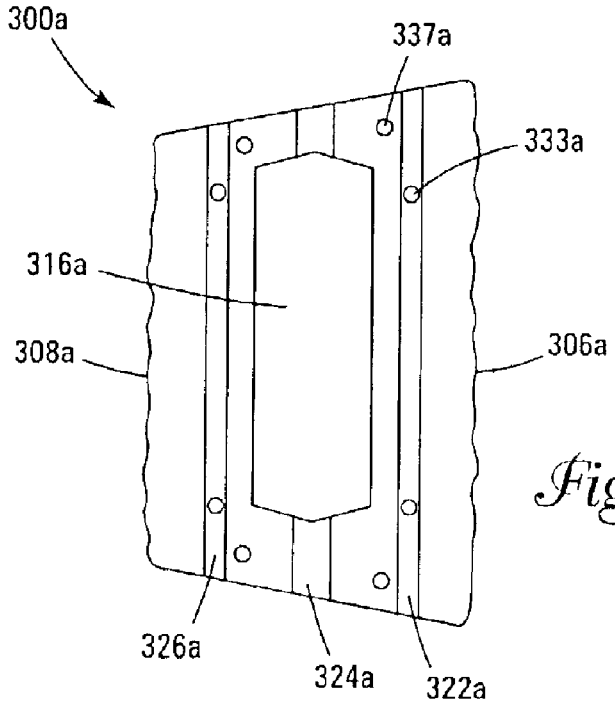
FIGS. 6A and 6B illustrate the bottom views of other versions of the blocks shown in FIGS. 1A and 3A, respectively.
Figure 6B:
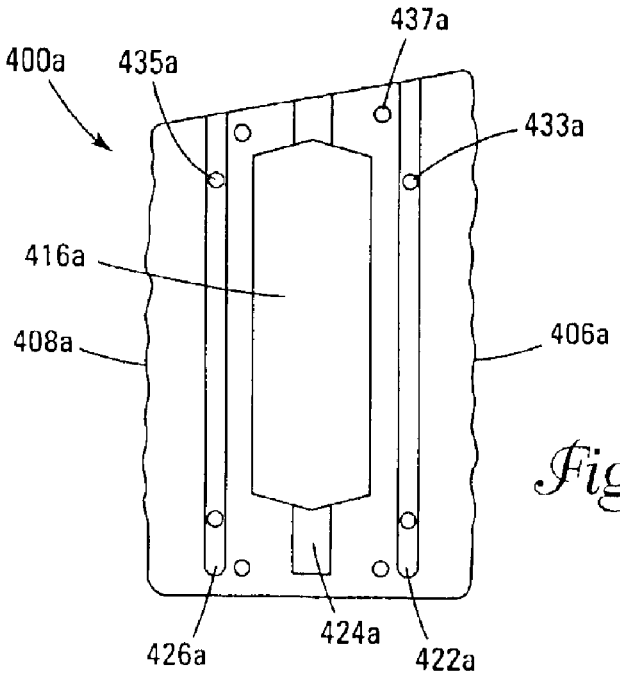

FIGS. 6A and 6B illustrate further variations of the first and second embodiments, respectively. Blocks 300*a* and 400*a* should be compared to blocks 100*a* and 200*a*. These blocks differ in that they lack the bridge or divider such as 118*a* and 218*a* of blocks 100*a* and 200*a*, respectively. The other elements are substantially similar as described above and are numbered accordingly.

Figure 7:
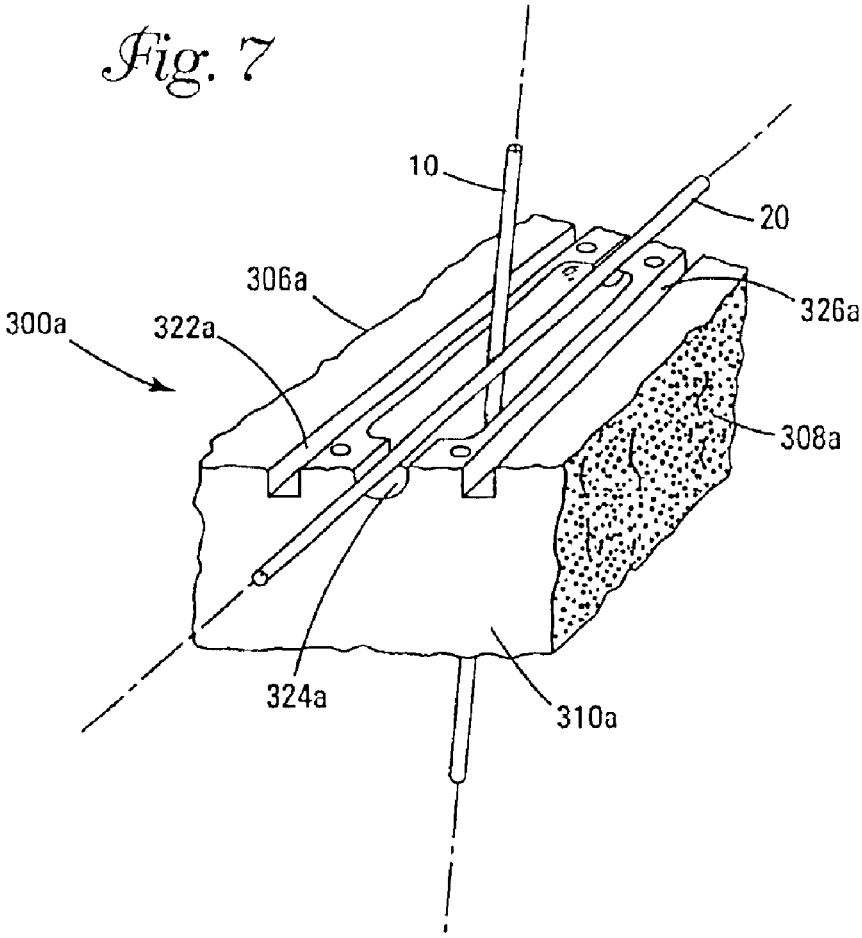
FIG. 7 illustrates a perspective view of a block of FIG. 6A, with the lower surface facing up, and with reinforcing members in place.

FIG. 7 illustrates block 300*a* of FIG. 6A with vertical and horizontal reinforcing members. The block is shown with its bottom or lower face up to show clearly the placement of reinforcing members. Vertical reinforcement rod 10 is shown through the core and horizontal reinforcement rod 20 is shown lying in channel 324*a*. Grout may be used in the channel to add further reinforcement. Suitable reinforcing rods include threaded steel (galvanized) post-tension rods, steel reinforcing bars (also referred to as "rebar", which may be natural and/or galvanized), fiberglass rods, and other reinforcing members that are suited for reinforcement in concrete/masonry.

Figure 8A:
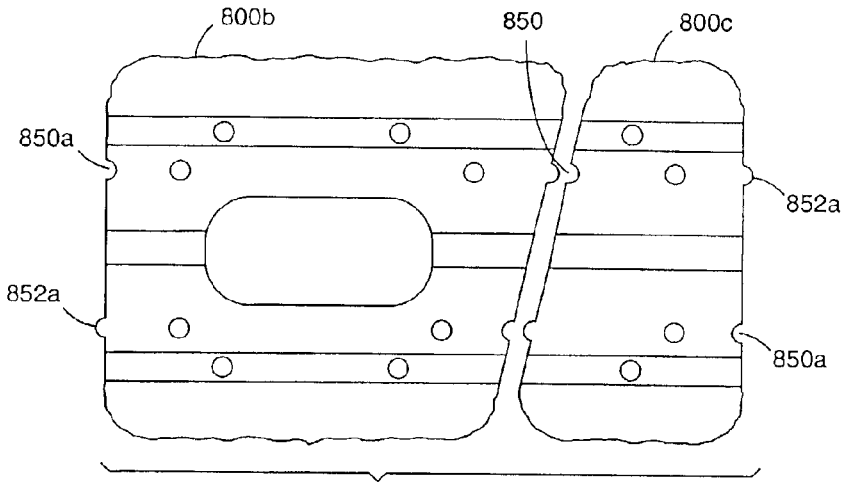
FIGS. 8A to 8G illustrate bottom views of blocks having various side connection systems.
Figure 8B:
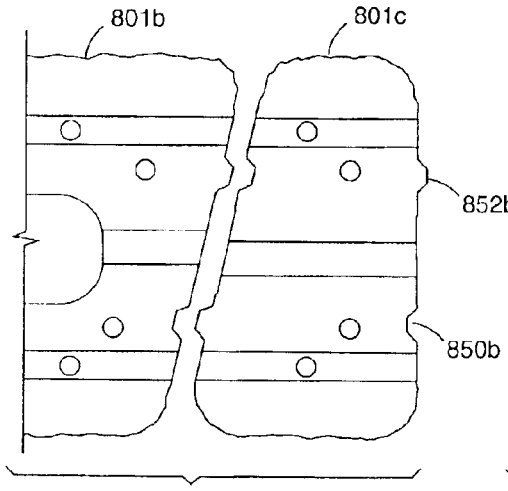
Figure 8C:
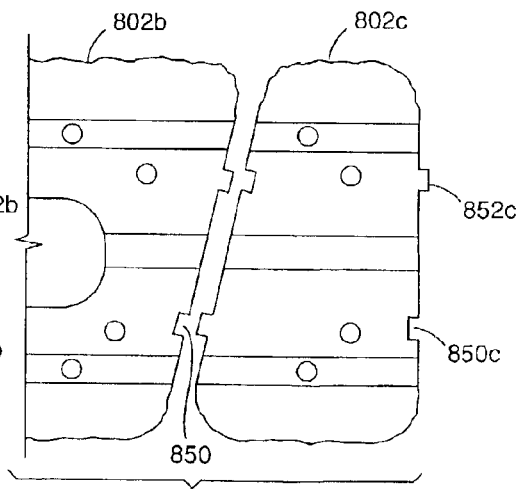
Figure 8D:
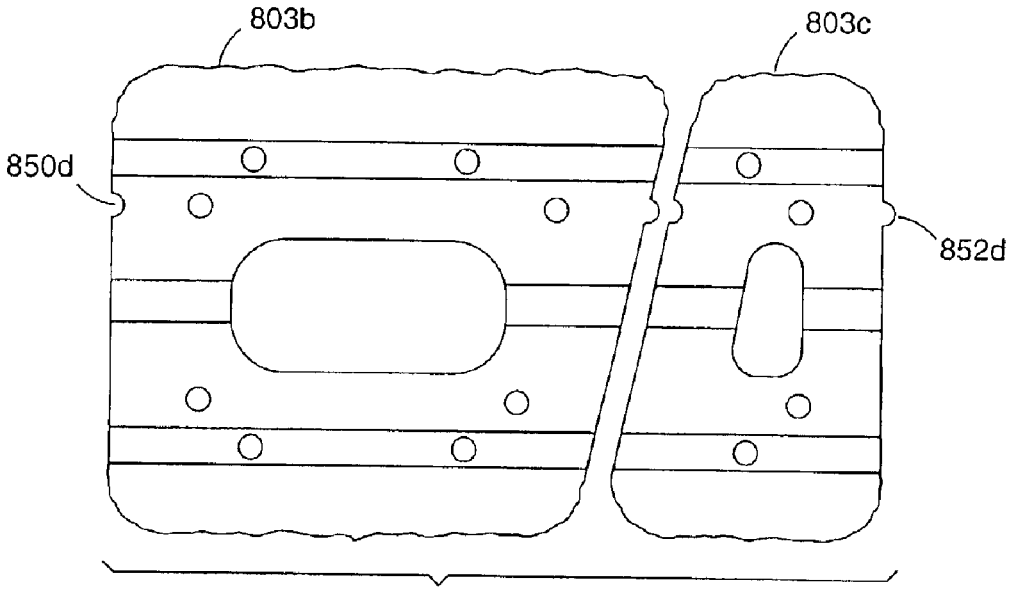
Figure 8E:
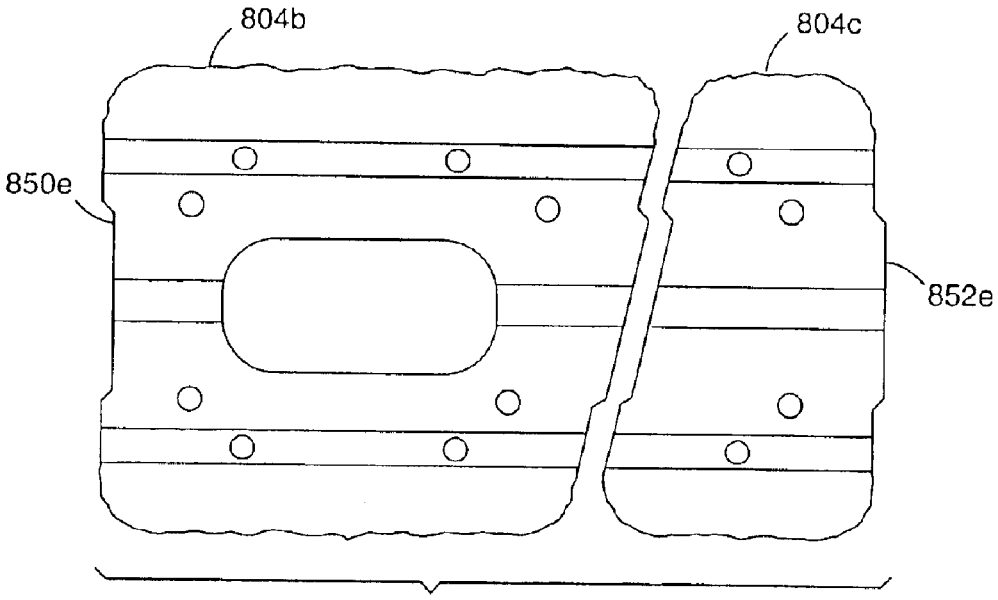
Figure 8F:
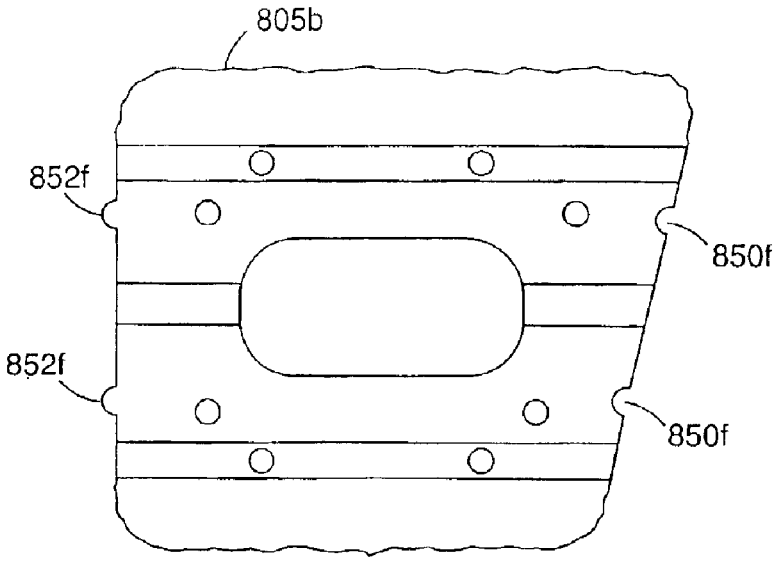
Figure 8G:
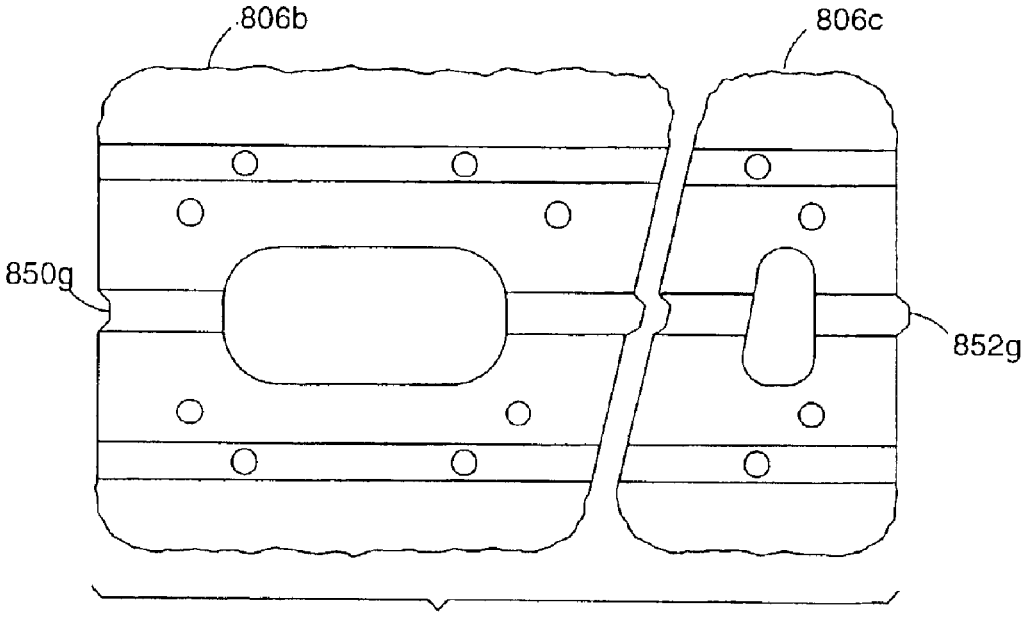

Various embodiments of side connection systems are illustrated in FIGS. 8A to 8G, where blocks are shown in bottom views. Blocks 800*b* and 800*c* in FIG. 8A align by means of two curvilinear slots 850*a* and projections 852*a* on the smooth side surfaces. The slots and projections can have a rectilinear shape, as illustrated in blocks 801*b* and 801*c* in FIG. 8B and 802*b* and 802*c* in FIG. 8C. FIG. 8D shows that blocks 803*b* and 803*c* align by means of offset slot and projection 850*d* and 852*d*, respectively. FIG. 8E illustrates blocks 804*b* and 804*c* configured to interlock by a single broad slot and projection 850*e* and 852*e*, respectively. FIG. 8F shows block 805*b* with two projections 852*f* on one side surface and two slots 850 on the other. These would engage with two corresponding projections or slots on adjacent blocks. FIG. 8G illustrates blocks 806*b* and 806*c* in which slot 850*g* and projection 852*g* are coincident with center channel 224*g*.

Figure 9:
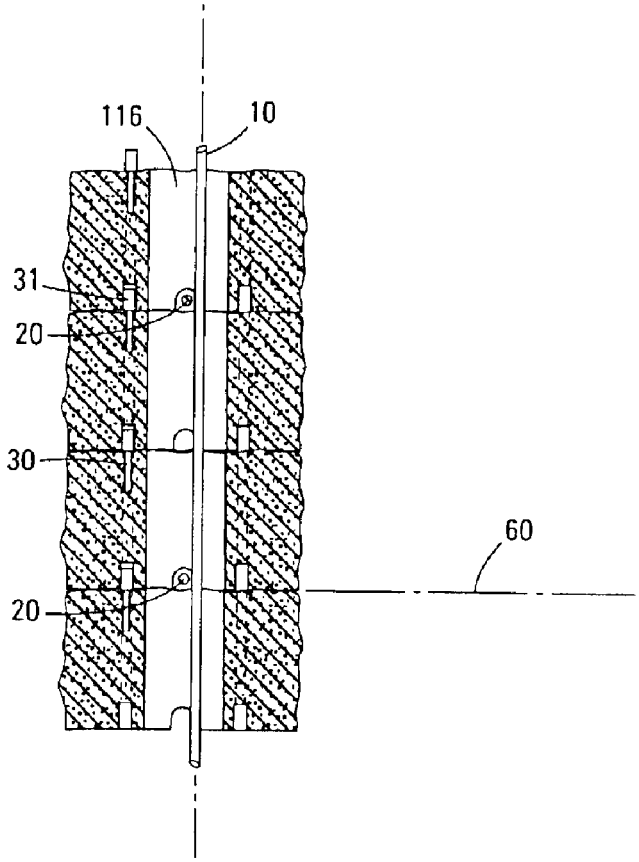
FIG. 9 illustrates a section view of a portion of a retaining wall according to this invention.
Figure 10:
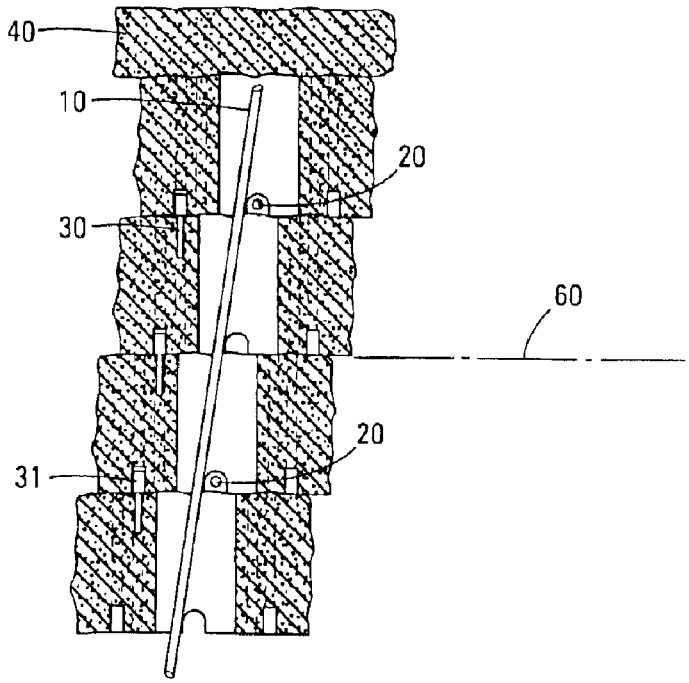
FIG. 10 illustrates a section view of a portion of a retaining wall according to this invention.
Figure 11:
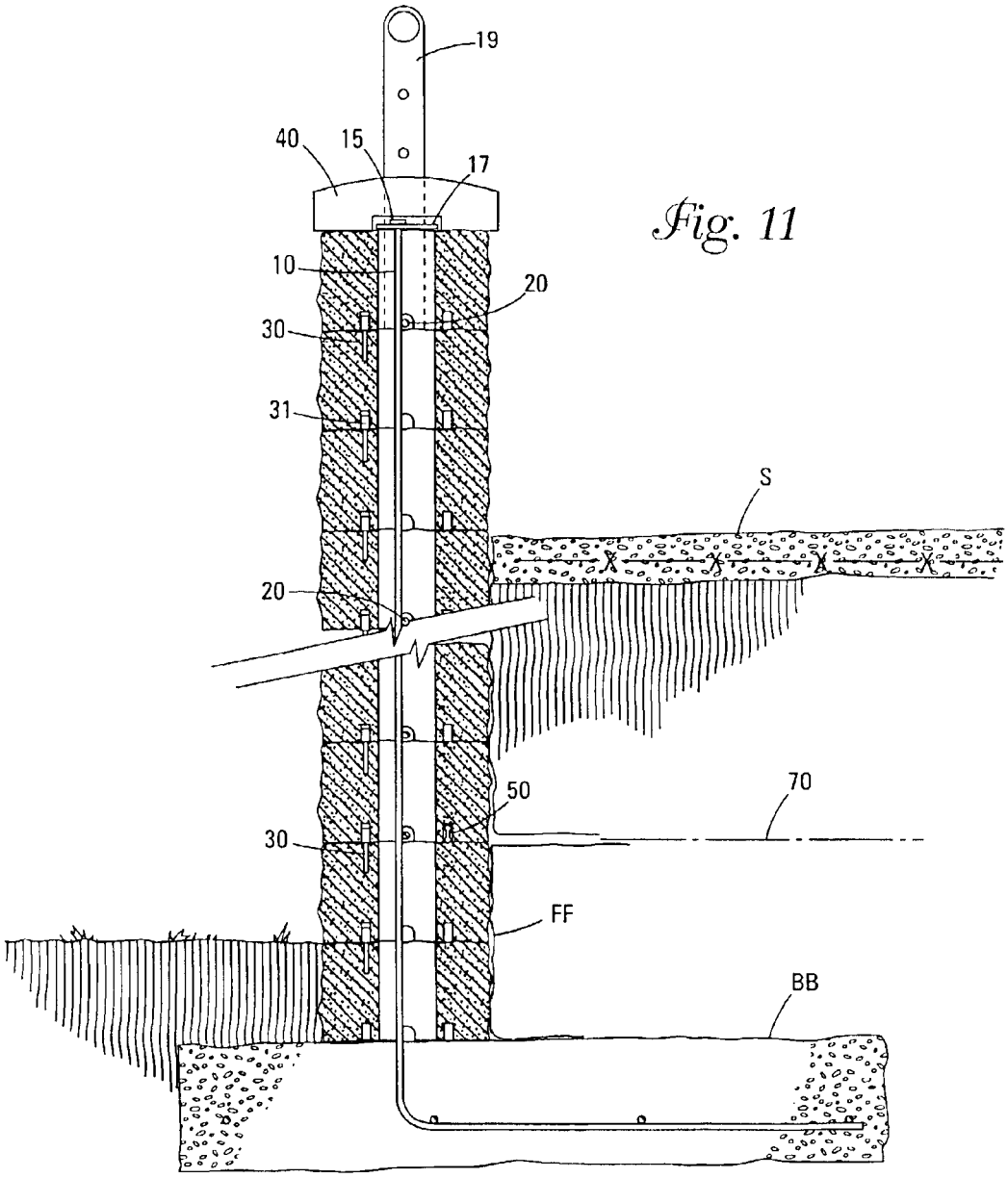
FIG. 11 illustrates a section view of the retaining wall system of this invention.

Various walls are illustrated in cross section in FIGS. 9, 10 and 11. With this block system, various sizes of blocks can be aligned directly over one another, thus aligning the cores. This permits the wall to be reinforced vertically, and yet, because of the different sizes of the blocks, a random, natural appearance can still be obtained for the wall. Various design members can be used, including guardrail/handrail that can be anchored into the cores of the blocks with cement grout in a vertical wall, such as that shown in FIG. 11. The present system of blocks, pins, and horizontal reinforcement 20 in the channels is shown in FIG. 9. Retaining pins 30 preferably are provided with a lip, shoulder, or head portion 31 that prevents the pins from slipping through a pin-receiving aperture. A pin is placed into a pin receiving cavity (e.g., 135) in a block on a lower course and is aligned so that the head portion 31 fits within a channel (e.g., 122 or 126) on the lower surface of a block above.

FIG. 10 is a side view of another type of retaining wall, in which the blocks of an upper course are set back from the blocks of a lower course, resulting in a wall that is set back or angled from vertical. In this set back, or staggered arrangement, pins are placed in apertures (e.g., 137) and the head of the pin fits in a channel (e.g., 122 or 126) of the block above the blocks. In addition, vertical reinforcing member 10 runs through the cores of the blocks and horizontal reinforcing members 20 run through the channels of the blocks. Both vertical and horizontal reinforcing members may be held in place and reinforced further by grout.

Cap, coping, or finish, layer 40 is installed at the top of the wall. The cap layer may comprise blocks, cut stone, or precast concrete pieces. Also, concrete can be cast in place for the finish layer. In any event, the cap layer may have any desired surface finish on its top and sides. Its thickness and appearance are matters of design choice. Typically the cap layer has no apertures that pass through its thickness. This layer may be affixed to the underlying course by means of adhesive (i.e., mortar or epoxy), pins, or other suitable means known to those of skill in the art.

FIGS. 9 and 10 also illustrate the use of a reinforcing material, or geogrid, which is generally a flat sheet of material arranged as a grid. It is contemplated that this reinforcing material is a relatively high strength geogrid, such high strength polymeric material (e.g., polyester, polyaramid, polypropylene) or high density polyethylene (HDPE), though other types of geogrid, geotextiles, or steel reinforcing may be suitable. Reinforcing material 60 may be installed and held in place by both the blocks and retaining pins 30 to create a mechanically stabilized earth retaining wall. Alternatively, various types of geogrid connectors, as known in the art, may be used in place of or in addition to the pins to hold the geogrid in place. The use of geogrids is known in the art and is described, for example, in U.S. Pat. No. Re. 34,314 (Forsberg), hereby incorporated herein by reference. After placement of a course of blocks to the desired height, the geogrid is placed so that the pins in the block penetrate the apertures of the geogrid. The reinforcing material is then laid back into the area behind the wall and put under tension by pulling back the reinforcing material. Backfill is placed and compacted over the reinforcing material, and the construction sequence continues as described above until another layer of reinforcing material is called for in the planned design. The use of a vertical reinforcing member also contributes to the resistance of pull out of the geogrid from the wall blocks.

FIG. 11 shows a cross section of a near-vertical or parapet wall, having capping layer 40, vertical reinforcing member 10, horizontal-reinforcing members 20 within the block channels, and geosynthetic reinforcement 70 held into place by connector 50 and tied into the earth behind the wall. When a railing is desired at the top of such a wall, railing support element 19 is fitted into a core of the blocks in the top course of blocks. Sidewalk or walkway S lies over the earth behind the wall. Connector 50, described further below, fits into a channel of the block (e.g., channel 222 or 226), and geogrid extends from there into the earth behind the wall. Typically, both channels are used in a wall, that is, one channel receives a connector, and the other channel is used to receive retaining pins, thus aligning the blocks.

An optional reinforcing system is shown for vertical reinforcement. That is, vertical reinforcing member 10 has a threaded section so that it can be held in place by washer 15 on compression plate 17 on the topmost course of blocks. Pins 30 are placed in the pin-receiving apertures of the blocks. Heads 31 of retaining pins 30 fit within a channel (122 or 126) of a block lying on top of the pin. Pins 30 function to align the blocks as well as to hold blocks in adjacent courses together.

To construct an internally reinforced retaining wall, a trench first is dug and cantilever concrete footing layer BB is placed in the trench. The first course of blocks is laid on top of footing layer BB. Both the footing layer and the first course of blocks are installed a designated distance below grade. A compacted free-draining granular leveling pad can be used in place of footing layer BB, if the free-standing parapet portion is not part of the wall design. The footing or leveling pad creates a level and somewhat flexible wall support base and eliminates the need to trench to a depth that would resist frost. That is, the footing can move as the ground freezes. Optional filter fabric FF is placed at the back surface of the wall. Filter fabric prevents the flow of fine silt or sand through the face of the wall but permits the flow of water, as is known to one of skill in the art.

Reinforcing member 10 extends vertically through the cores of the blocks and extends horizontally into the footing. Geosynthetic reinforcement or geotextile 70 is installed between designated courses of the blocks and held in place by a connector adapted to fit into a channel of the block, as described further below. The desired number of courses of blocks are added. The wall is finished, or capped, with cap layer 40.

Geosynthetic reinforcement 70 is a relatively flexible geogrid that, for example, comprises a rectilinear polymer construction characterized by large (e.g., 1 inch (25 cm) or greater) openings. In typical open structure geogrids, polymeric strands are woven or "welded" (by means of adhesives and/or heat) together in a grid. Polymers used for making relatively flexible geogrids include polyester fibers. The polyester typically is coated with a polyvinyl chloride (PVC) or a latex topcoat. The coating may contain carbon black for ultraviolet (UV) stabilization. Some open structure geogrids comprise polyester yarn for the warp fibers and polypropylene as the fill fibers. Geosynthetic reinforcement 70 may also comprise geosynthetic fabric, i.e., woven constructions without large openings. These fabrics typically comprise polymers and are referred to as geofabrics.

Figure 12C:
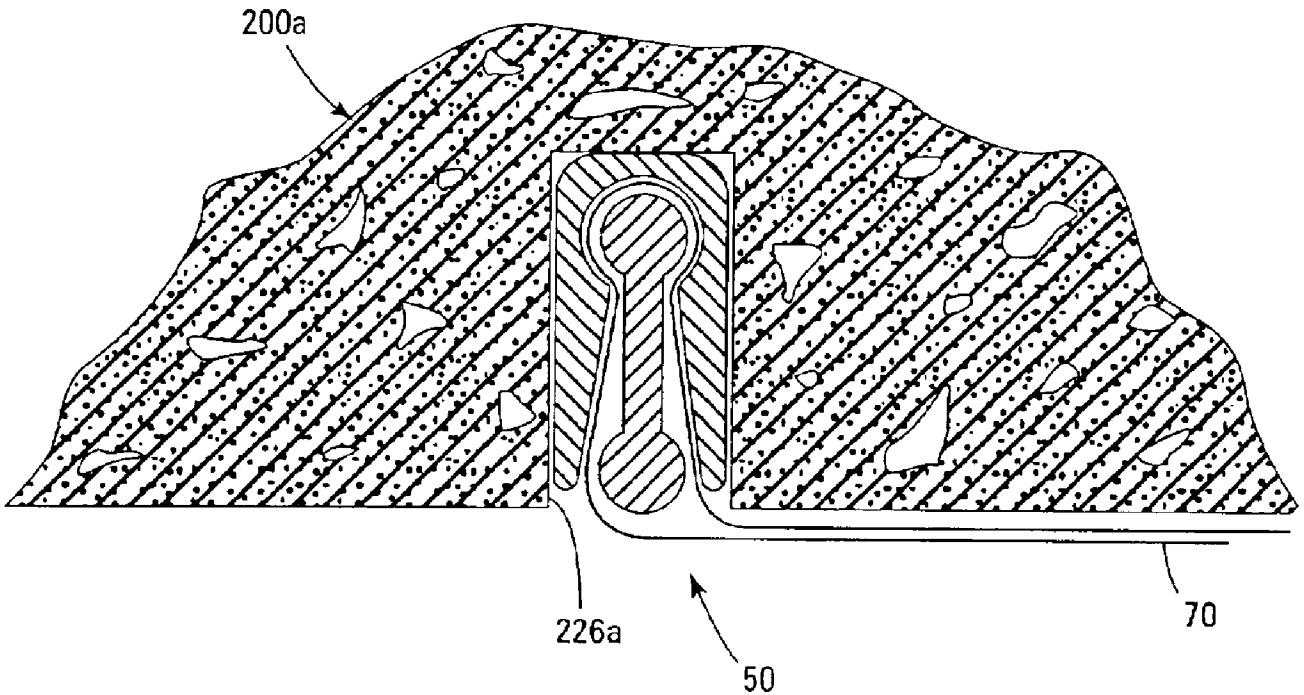
FIG. 12C illustrates a detailed view of the connector in place in a block channel.

FIG. 12A shows a perspective view of connector 50. Connector 50 is described in co-pending, commonly assigned U.S. patent application Ser. No. 09/904,037, filed Jul. 12, 2001, entitled "Grooved Retaining Wall Block and System", hereby incorporated herein by reference. Connector 50 includes channel portion 52 having first and second sides defining channel 54 therebetween and elongate bar 56 configured to engage a section of the geogrid within the channel. Connector 50 is sized to be accommodated within the channel of a block when the geogrid is engaged in the channel. A cross sectional view of connector 50 is shown in FIG. 12B, and FIG. 12C illustrates geosynthetic reinforcement 70 held in a channel (e.g., channel 226*a* of block 200*a*) by connector 50. FIG. 12C shows that the channel of the connector opens onto the lower surface of the block. The connector could also be oriented so that one of the surfaces of the channel connector faces the lower surface of the block.

Connector 50 comprises rigid polymeric material such as polyvinyl chloride or polyethylene copolymer and may be formed by extruding a suitable material into the desired shape. It also may comprise fiberglass, aluminum, galvanized steel, or the like. Connector 50 includes channel connector 52 having channel 54 which is configured to receive geosynthetic material. An end of the geofabric is laid into the channel and held in place by connector bar 56.

The connector illustrated in these figures is about 1 inch (2.5 cm) high and about ⅝ inch (1.6 cm) wide though any desired dimensions can be used for this connector. The length of the connector also may be any desired length, though for this wall the connector preferably is a length sufficient to accommodate the width of the geogrid/geofabric.

Figure 13:
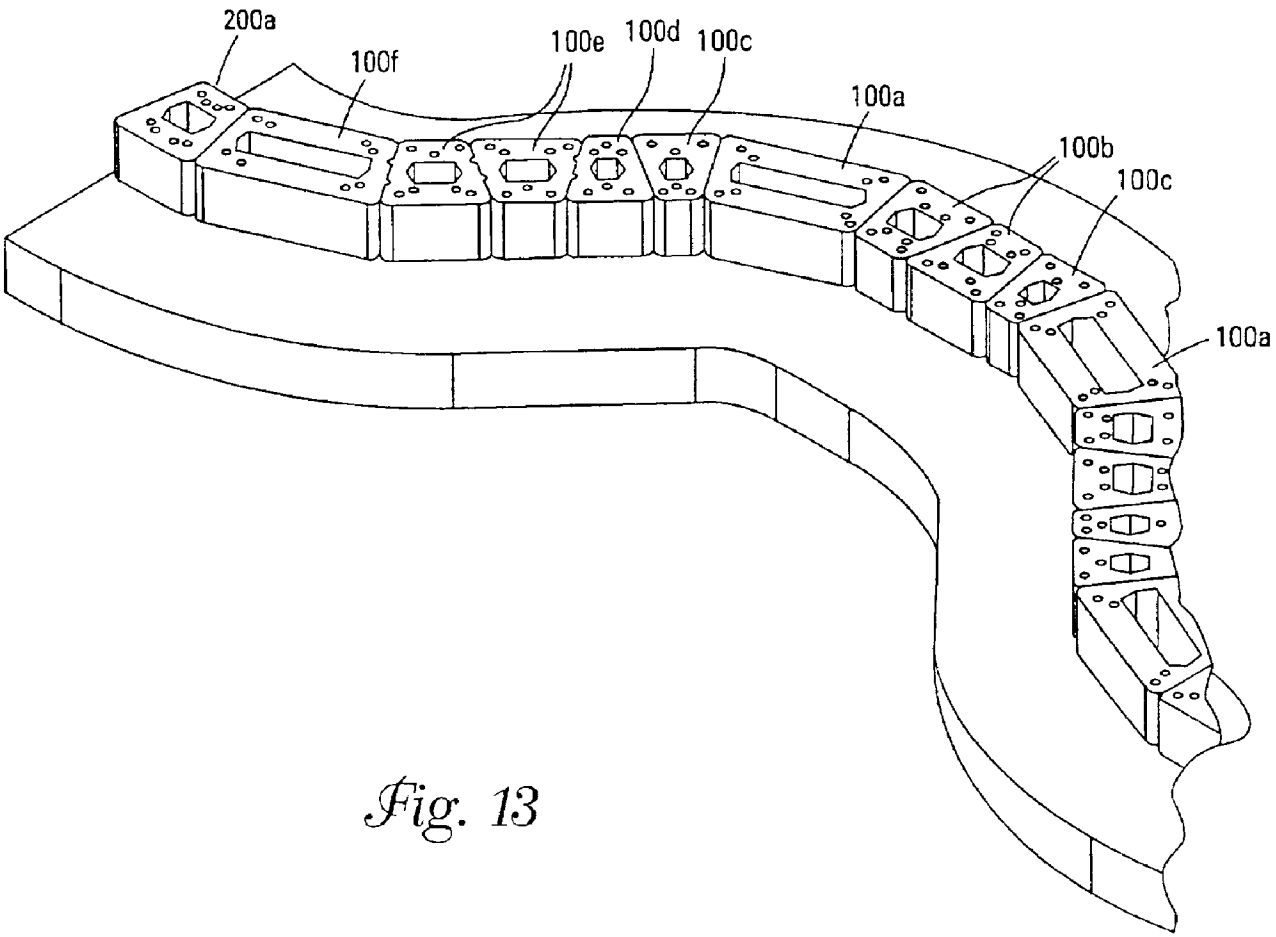
FIG. 13 illustrates a perspective view of one course of blocks in a serpentine arrangement.

FIG. 13 illustrates one course of blocks laid in a serpentine pattern. The surface having channels is facing downward. The course of blocks includes blocks 100*a*, 100*b*, 100*c* with block 200*b* on the end, at the left side. In this way, the left side has a finished appearance, since channels do not open onto the left side. For purposes of illustration, blocks having a side connection system (100*e* and 100*d* with slot and projection on one side only) are also shown in a straight section of this course of blocks. This shows the mating of the side connection system in the blocks. This figure also illustrates that both first and second surfaces of the block form the face of a wall.

Figure 14:
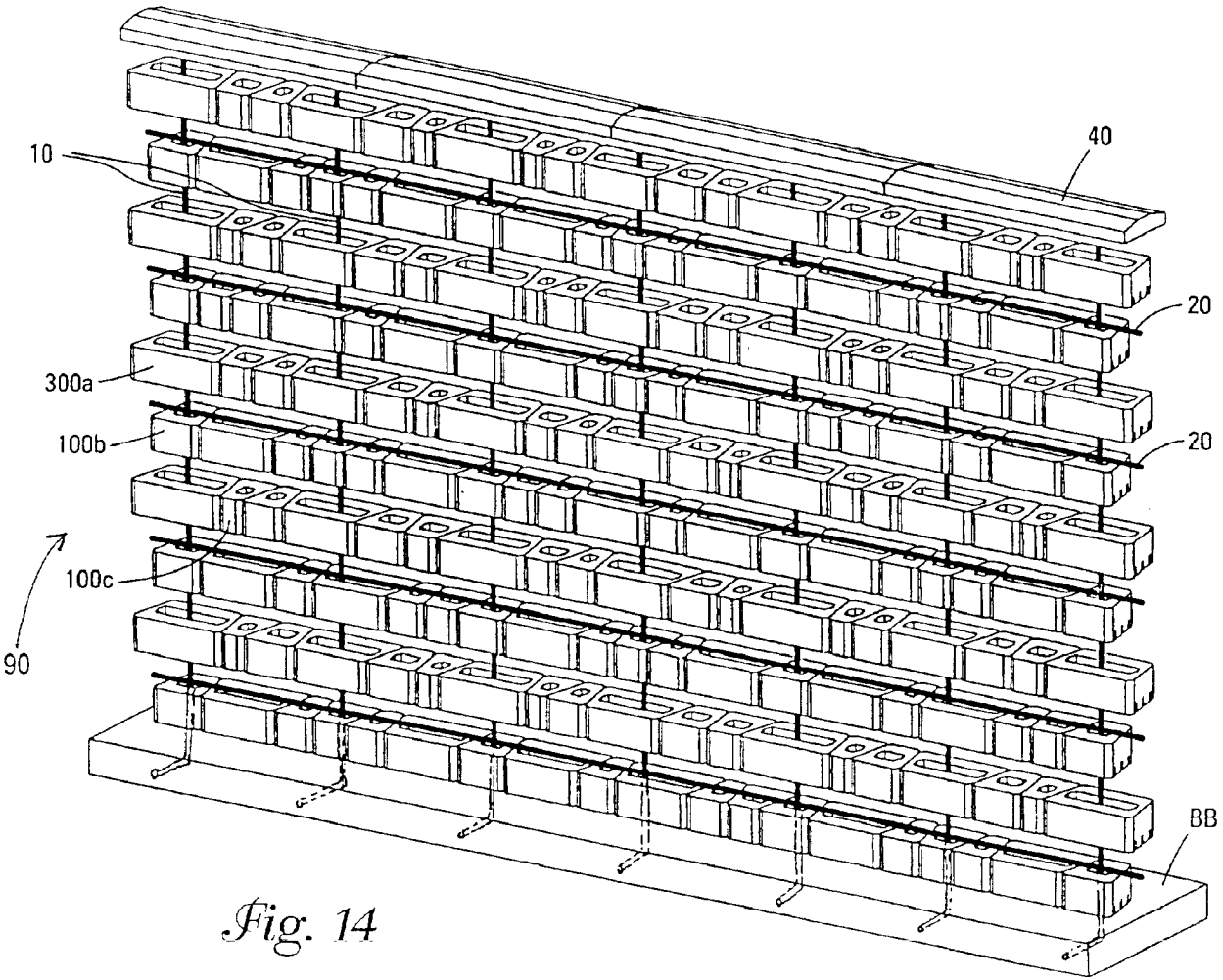
FIG. 14 illustrates an exploded view of a reinforced wall formed from the blocks of this invention.
Figure 15:
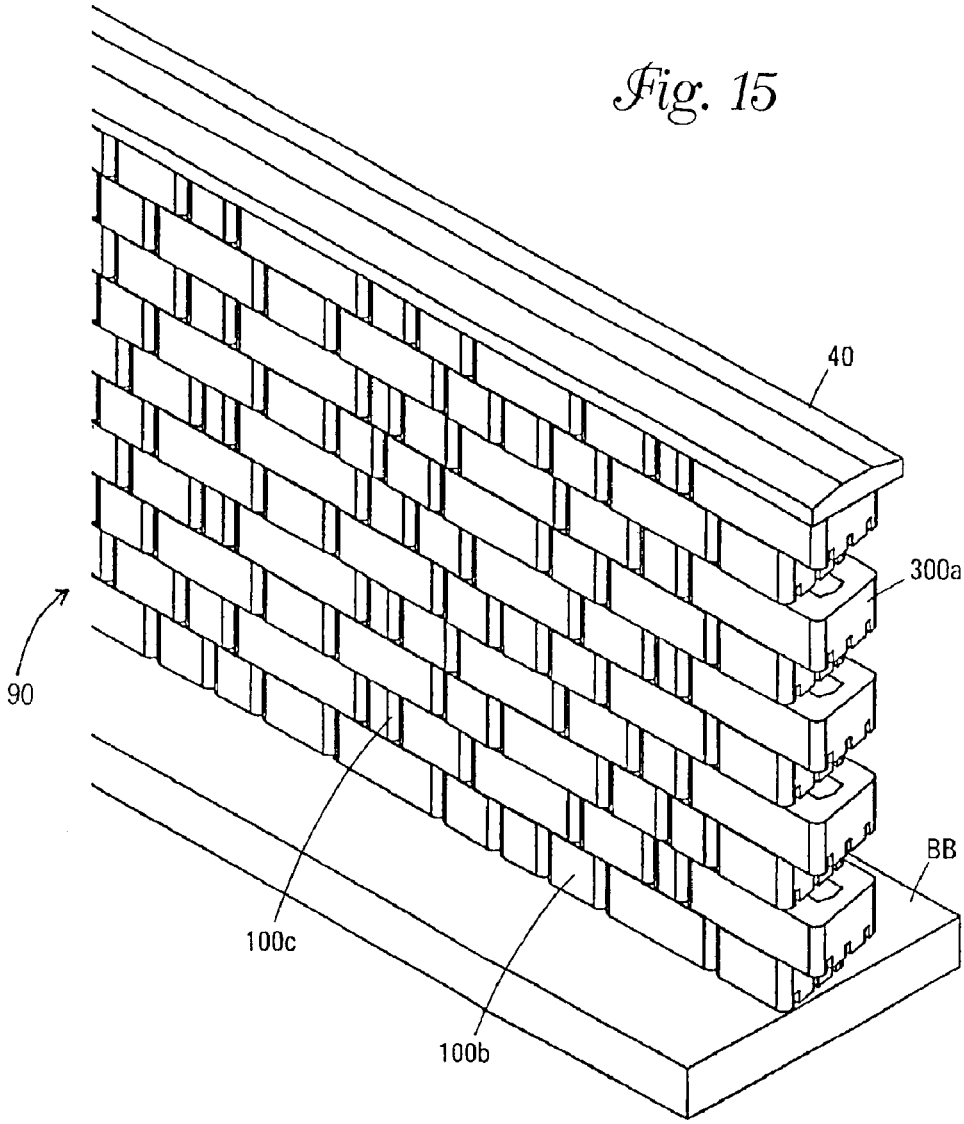
FIG. 15 illustrates a perspective view of the wall of FIG. 14.

FIGS. 14 and 15 show an unfinished reinforced freestanding or retaining wall and FIG. 14 illustrates the exploded view of this wall. Wall 90 is constructed with the blocks of this invention and reinforced vertically with vertical reinforcement members 10 in place through the cores of the randomly stacked blocks. Wall 90 is also reinforced horizontally by horizontal reinforcing members 20 that are laid in the center channel (e.g., 124) and extend the length of the wall. Footing BB also is shown in the figures, and vertical reinforcing members 10 can be seen extending into footing BB in FIG. 14. For the sake of simplicity, no pin receiving apertures are shown.

FIGS. 14 and 15 show wall 90 without end blocks (such as 200*a*, 200*b*, and 200*c*) that would form a right angle at the end of the wall. The right side of the wall illustrates the appearance and position of the blocks and the channels therein. Each block is the same in length (i.e., distance from first to second face, or front to back) but different in width (i.e. distance from first to second side). Three blocks (e.g., 300*a*, 100*b*, and 100*c*) and capping layer 40 are shown. Either a reinforced retaining wall or parapet wall can be constructed with various sizes of blocks of this invention.

Figure 16:
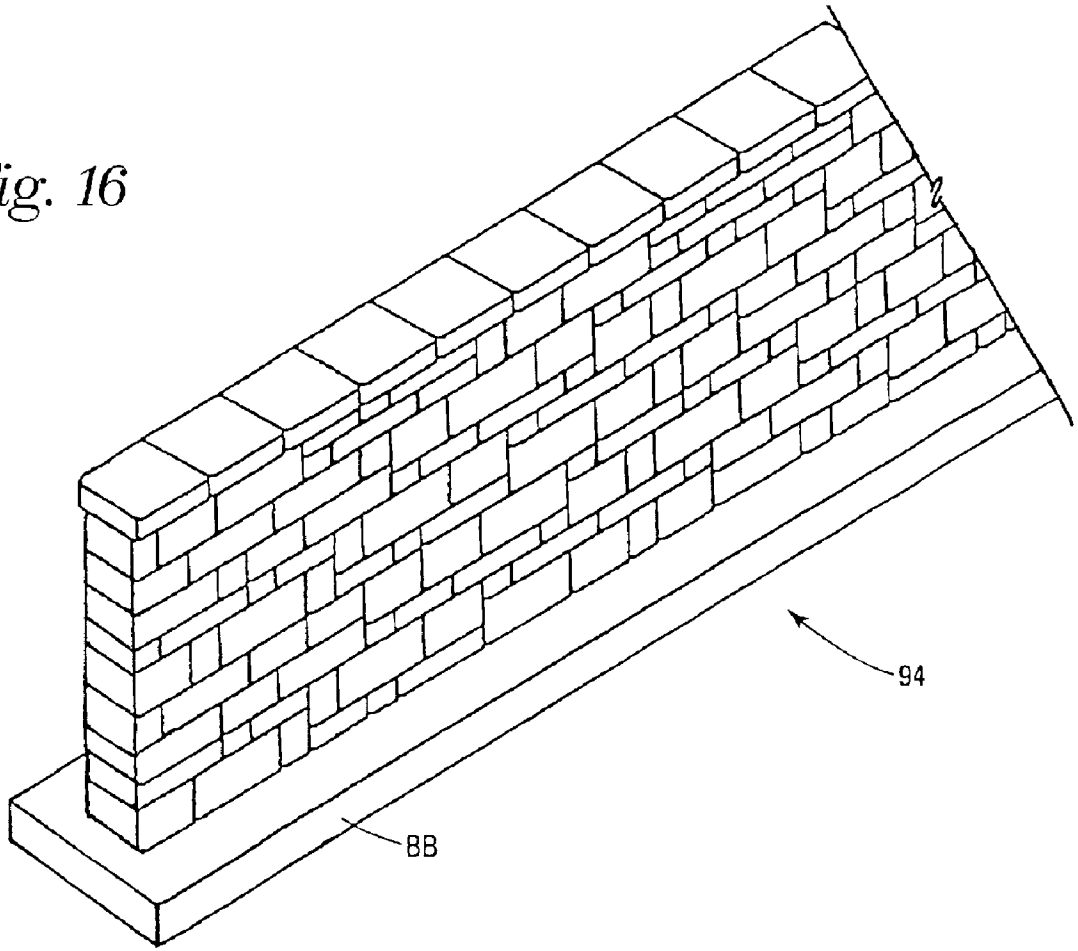
FIG. 16 illustrates a perspective view of a wall formed from blocks of varying thicknesses.

FIG. 16 illustrates free-standing wall 94 with the blocks of this invention having various thicknesses. The wall may be made with blocks having the side connection system described above. This is particularly useful for a free-standing wall, as the interlocking slots and projections prevent light from being seen through the wall as well as adding greater stability to the wall. The use of various thicknesses as well as different widths of blocks results in a pleasant random appearance (ashlar pattern) for the wall.

Although particular embodiments have been disclosed herein in detail, this has been done for purposes of illustration only, and is not intended to be limiting with respect to the scope of the claims. In particular, it is contemplated that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A wall having a from surface and a rear surface, the wall comprising:

at least a first lower course and a second upper course, each course comprising a plurality of blocks, each block having an upper surface spaced apart from an opposed lower surface, thereby defining a block thickness, opposed first and second faces, the first face having an area greater than the second face, opposed and non-parallel side surfaces, the first and second faces together with the upper, lower and side surfaces forming a block body, one of the side surfaces of at least one block having at least one elongate slot extending between the upper and lower surfaces, the other of the side surfaces of the at least one block having a projection shaped to mate with a slot on a side surface of an adjacent block in the wall;

the blocks being positioned in the courses such that the front surface of the wall includes a plurality of the first faces of the blocks and a plurality of the second faces of the blocks;

wherein the lower surface of the block further comprises first and second channels substantially parallel to the first and second faces; and wherein the blocks further comprise at least one pin receiving aperture, and the wall further comprises pins, each pin having a head portion and a body portion, the head portion being configured to be received within one of the at least two channels of the lower surface of the block in the second upper course of the wall and the body portion being configured to be received in the pin receiving aperture of the block in the first lower course of the wall.

2. The wall of claim 1 wherein the lower surface of the block further comprises a third channel substantially parallel to the first and second faces.

3. The wall of claim 1 wherein the wall further comprises horizontal reinforcing members adapted to fit within one of the first and second channels of the blocks.

4. The wall of claim 1 wherein each block has the same thickness.

5. The wall of claim 1 further wherein the width of the blocks is defined by the first face of the blocks and wherein the blocks comprise blocks of three different block widths.

6. The wall of claim 1 wherein each of the blocks further comprises at least one core extending the thickness of the blocks.

7. The wall of claim 6 wherein the wall further comprises vertically aligned blocks in the first lower course and the second upper course and vertical reinforcing members adapted to fit through the cores of vertically aligned blocks.

8. The wall of claim 1 wherein the pin receiving apertures are substantially perpendicular to the upper and lower surfaces of the blocks.

9. The wall of claim 1 wherein the first face and the second face are textured in a manner resulting in the appearance of natural stone.

10. A wall system for constructing a reinforced retaining wall having at least a first lower course of blocks and a second upper course of blocks, the wall system comprising;

a plurality of blocks, each block having an upper surface spaced apart from a substantially parallel lower surface, thereby defining a block thickness; opposed and substantially parallel first and second faces, the first face having an area greater than the second face; opposed and non-parallel side surfaces, the first and second faces together with the upper, lower and side surfaces forming a block body, the lower surface having first and second channels substantially parallel to the first and second faces, one of the side surfaces of at least one block having at least one elongate slot extending between the upper and lower surfaces, the other of the side surfaces of the at least one block having a projection shaped to mate with a slot on a side surface of an adjacent block in the wall, the upper surface of the blocks having at least one pin receiving aperture;

a pin sized to be contained within the pin receiving aperture of a block to extend above the upper surface of the block a predetermined distance;

a geogrid; and a geogrid connector, the blocks being configured such that they are capable of being positioned when constructing the wall so that the first channel of the lower surface of a block in the upper course receives a pin extending from the upper surface of a block of the lower course and the second channel of the lower surface of the block in the upper course receives the geogrid connector such that the geogrid is secured within the second channel by the geogrid connector.

11. A method of constructing a wall, the wall having a front surface and a rear surface, the method comprising:

providing a plurality of first and second blocks, each block having an upper surface spaced apart from an opposed lower surface, thereby defining a block thickness; each block having opposed first and second faces, thereby defining a block length therebetween, the first face having an area greater than the area of the second face;

the first and second blocks each having opposed and non-parallel side surfaces, thereby defining a block width therebetween, one of the side surfaces being substantially perpendicular to the first face, one of the side surfaces having at least one elongate slot extending between the upper and lower surfaces, the other of the side surfaces having a projection shaped to mate with a slot on a side surface of an adjacent block in the wall; wherein each of the first and second blocks has at least one pin receiving aperture extending through the block thickness substantially perpendicular to the upper and lower surfaces at least two channels formed on the lower surface of each of the first and second blocks;

placing the blocks in at least a first lower course and a second upper course such that the front surface of the wall is comprised of the first faces of the plurality of the first and second blocks and the second faces of a plurality of the first and second blocks;

placing a pin having a head portion and a body portion into the at least one pin receiving aperture such that the body portion is in the pin receiving aperture of the block in the first lower course and the head portion is configured to be received in one of the at least two channels of the block in the second upper course; and placing a geogrid between the first lower course and the second upper course.

12. The method of claim 11 wherein, in the step of providing the plurality of blocks, the at least two channels of the first and second blocks open onto the first and second side surfaces, each channel parallel to the first and second faces.

13. A method for constructing a reinforced retaining wall system having at least a first lower course of blocks and a second upper course of blocks, the method comprising:

providing a plurality of blocks, each block having an upper surface spaced apart from an opposed lower surface, thereby defining a block thickness, opposed first and second faces, the first face having an area greater than the second face, opposed and non-parallel side surfaces, the first and second faces together with the upper, lower and side surfaces forming a block body, the lower surface having first and second channels substantially parallel to the first and second faces, the upper surface of the blocks having at least one pin receiving aperture, one of the side surfaces having at least one elongate slot extending between the upper and lower surfaces, the other of the side surfaces having a projection shaped to mate with a slot on a side surface of an adjacent block in the wall;

placing a pin within the pin receiving aperture of a block, the pin extending above the upper surface of the block a predetermined distance;

providing a geogrid and a geogrid connector; and positioning the blocks in at least one first lower course and one second upper course so that a projection on the side surface of one of the blocks mates with the slot on the side surface of an adjacent block and so that the first channel of the lower surface of one block in the upper course receives the pin extending from the upper surface of one block of the lower course and the second channel of the lower surface of the block in the upper course receives the geogrid connector such that the geogrid is secured within the second channel by the geogrid connector.

14. A wall having at least a first lower course of blocks and a second upper course of blocks, the wall comprising:

a plurality of wall blocks, the blocks in the upper course being connected to blocks in the lower course by pins extending from a top surface of blocks in the lower course and received by a pin receiving cavity formed in a bottom surface of blocks in the upper course;

the wall block comprising an upper surface spaced apart from an opposed lower surface, thereby defining a block thickness, opposed first and second faces, the first face having an area greater than the second face, opposed and non-parallel side surfaces, the first and second faces together with the upper, lower and side surfaces forming a block body, one of the side surfaces of at least one block having at least one elongate slot extending between the upper and lower surfaces, the other of the side surfaces of the at least one block having at least one projection shaped to mate with at least one slot on a side surface of an adjacent block in the wall;

the front surface of the wall including a plurality of the first faces of the blocks and a plurality of the second faces of the blocks and the wall being formed such that the projection on the side surface of one of the blocks mates with a slot on the side surface of an adjacent block; and wherein each wall block of the plurality of wall blocks further comprises a lower surface having first and second channels substantially parallel to the first and second faces, such that the first channel functions as the pin receiving cavity when the first face forms a portion of the front surface of the wall and the second channel functioning as the pin receiving cavity when the second face forms a portion of the front surface of the wall.

15. A method of constructing a wall having at least a first lower course of blocks and a second upper course of blocks, comprising:

providing a plurality of wall blocks, each block comprising an upper surface spaced apart from an opposed lower surface, thereby defining a block thickness; a pin receiving aperture substantially perpendicular to the upper and lower surfaces, opposed first and second faces, the first face having an area greater than the second face, opposed and non-parallel side surfaces, the first and second faces together with the upper, lower and side surfaces forming a block body; onc of the side surfaces having at least one elongate slot extending between the upper and lower surfaces, the other of the side surfaces having a projection shaped to mate with a slot on a side surface of an adjacent block in the wall;

placing a pin in the pin receiving aperture so that it extends from the top surface of the block in the lower course;

connecting the blocks in the upper course to the blocks in the lower course by the pin received by the pin receiving aperture on the bottom surface of blocks in the upper course, such that the front surface of the wall is formed of the first faces of some of the multiple wall blocks and the second faces of others of the multiple wall blocks and such that the projection on the side surface of one of the blocks mates with a slot on the side surface of an adjacent block; and the lower surface of the wall block further comprises first and second channels substantially parallel to the first and second faces such that the first channel functions as the pin receiving aperture when the first face forms a portion of a front surface of the wall and the second channel functions as the pin receiving aperture when the second face forms a portion of a front surface of the wall.

* * * * *